US008029126B2

(12) United States Patent
Imoto

(10) Patent No.: US 8,029,126 B2
(45) Date of Patent: Oct. 4, 2011

(54) IMAGE FORMING APPARATUS

(75) Inventor: Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 497 days.

(21) Appl. No.: 12/204,211

(22) Filed: Sep. 4, 2008

(65) Prior Publication Data

US 2009/0073211 A1 Mar. 19, 2009

(30) Foreign Application Priority Data

Sep. 13, 2007 (JP) ..... 2007-237618

(51) Int. Cl.
*B41J 29/38* (2006.01)
*B41J 2/01* (2006.01)
*G03G 15/00* (2006.01)

(52) U.S. Cl. ..... 347/104; 347/16; 347/105; 399/406

(58) Field of Classification Search ..... 347/16, 347/101, 102, 104–106; 399/406
See application file for complete search history.

(56) References Cited

U.S. PATENT DOCUMENTS

| | | | | |
|---|---|---|---|---|
| 4,926,358 | A | 5/1990 | Tani et al. | |
| 5,414,503 | A * | 5/1995 | Siegel et al. | 399/406 |
| 5,672,018 | A | 9/1997 | Yamamoto et al. | |
| 7,334,858 | B2 | 2/2008 | Kogure et al. | |
| 2003/0156176 | A1 | 8/2003 | Miyamoto et al. | |
| 2005/0265741 | A1 | 12/2005 | Otsuka | |
| 2006/0050815 | A1 | 3/2006 | Vandewiele et al. | |
| 2006/0055754 | A1 | 3/2006 | Sakuma et al. | |
| 2006/0164491 | A1 | 7/2006 | Sakuma et al. | |
| 2007/0109385 | A1 | 5/2007 | Imoto et al. | |
| 2008/0043083 | A1 | 2/2008 | Imoto et al. | |
| 2008/0145123 | A1 | 6/2008 | Kogure et al. | |
| 2008/0187340 | A1 | 8/2008 | Otsuka | |
| 2009/0052917 | A1 | 2/2009 | Kogure et al. | |

FOREIGN PATENT DOCUMENTS

| | | |
|---|---|---|
| JP | 2000-1010 | 1/2000 |
| JP | 3109529 | 9/2000 |
| JP | 2003-248349 | 9/2003 |
| JP | 2005-292651 | 10/2005 |
| JP | 2006-82546 | 3/2006 |
| JP | 2007-76266 | 3/2007 |

OTHER PUBLICATIONS

Oct. 12, 2010 European search report in connection with a counterpart European patent application No. 08252984.

* cited by examiner

*Primary Examiner* — Daniel Petkovsek
(74) *Attorney, Agent, or Firm* — Cooper & Dunham LLP

(57) ABSTRACT

A disclosed image forming apparatus has a recording head for ejecting droplets of recording liquid and forms an image on a recording medium. The image forming apparatus includes a decurling unit configured to perform decurling of the recording medium and adjusts the decurling of the recording medium based on a first information piece about the degree of curl of the recording medium and a second information piece about a subsequent recording medium on which an image is to be formed after the image is formed on the recording medium.

14 Claims, 24 Drawing Sheets

IMAGE FORMING APPARATUS

BACKGROUND

1. Technical Field

This disclosure relates to an image forming apparatus, and particularly relates to an image forming apparatus having a recording head that forms an image by ejecting liquid droplets.

2. Description of the Related Art

Image forming apparatuses (e.g. printers, fax machines, copiers, and multifunction machines having functions of these machines) are known that perform image formation by ejecting a liquid (a recording liquid) such as ink onto a medium using, for example, a liquid ejection device while transporting the medium. The liquid ejection device comprises a recording head including a liquid ejection head for ejecting droplets of the recording liquid (ink). It is to be noted that the term "medium" as used herein is also referred to as a "sheet", which may be paper or may be made of other materials. The terms "to-be-recorded medium", "recording medium", "transfer material", and "recording sheet" may be used as synonyms for the term "medium". The terms "recording", "printing", and "imaging" may be used as synonyms for the term "image formation".

The term "image forming apparatus" as used herein indicates an apparatus that forms images by ejecting liquid onto media such as paper, strings, fibers, cloth, leather, metal, plastic, glass, wood, and ceramics. The term "image formation" as used herein indicates not only forming images that have meanings, such as characters and figures, on a medium, but also forming images that do not have meanings, such as patterns, on a medium, and applying a material having desired properties onto any position on a medium. The "ink" is not limited to an ink but may include any liquid such as liquid that are commonly called ink, recording liquid, DNA samples, resist, resin materials, patterning materials, and materials that have desired properties (e.g., light emitting properties, light blocking properties, conductive properties, fixative properties, glossy properties, and liquid absorbability).

In image forming apparatuses using such an ink, because an image is formed using the ink, a certain amount of time is required for the ink ejected on a recording medium to be dried. Therefore, the recording medium on which an image is formed is held in a waiting mode inside the apparatus until the ink ejected on the recording medium is dried. In the case of duplex printing, the recording medium is ejected onto a discharge tray and then is fed again.

For example, Japanese Patent Registration No. 3109529 (corresponding to Japanese Patent Laid-Open Publication No. 4-255354) discloses an inkjet printer that includes a unit that delays discharge of a recording sheet to a discharge tray for a set period of time if the dot density of the previous determination result is higher than a predetermined value.

Japanese Patent Laid-Open Publication No. 2000-001010 (corresponding to Japanese Patent Registration No. 3681093) discloses an inkjet recording apparatus that, after printing one side of a sheet, discharges at least a part of the sheet outside the apparatus to secure drying time, and then prints the other side of the sheet.

Japanese Patent Laid-Open Publication No. 2006-082546 discloses an image forming apparatus that causes a recording medium, on which an image is formed by a recording head, to wait until the recording medium becomes difficult to be curled while holding the upper side and the lower of a part of the recording medium, and then discharges the recording medium.

Japanese Patent Laid-Open Publication No. 2003-248349 discloses an image forming apparatus, such as a laser printer that forms an image using toner, that delays discharge of a sheet of poor fixative properties such as an OHP sheet by causing the sheet to be held at a discharge port until the temperature of the sheet decreases.

Japanese Patent Laid-Open Publication No. 2005-292651 discloses a fixing device that includes plural fixing units for fixing a toner image onto a sheet, a bypass path for transporting the sheet not to pass through at least one of the fixing units, a main path for transporting a sheet to pass through at least one of the fixing units, and a path switching unit disposed at a branching point of the main path and the bypass path and configured to select one of the paths to which the sheet is guided. The main path and the bypass path join together at a joining point. The time required to transport the sheet from the branching point to the joining point via the main path is substantially equal to the time required to transport the sheet from the branching point to the joining point via the bypass path.

Highly viscous ink tends to be used in the image forming apparatuses in order to achieve high-speed and high-quality image printing on plain paper. Especially, in the case of pigment ink using organic pigment, carbon black or the like as colorant, the pigment is not soluble in water unlike dye. Therefore, the pigment ink is normally used as aqueous ink mixed with dispersant in which the pigment is stably dispersed by the dispersant. Such aqueous ink generally has high viscosity (5 mPa·s or greater). If this aqueous ink is used for forming an image on plain paper (recording medium), although the ink dries quicker than dye ink, the recording medium is likely to be curled.

In the case of dye ink, water penetrates to reach the back side of the recording medium, so that the difference in water content between the front side and the back side of the recording medium is small. Accordingly, although it takes time for the ink to dry, curling due to the difference in water content between the front side and the back side of the recording medium is relatively not likely to occur. On the other hand, in the case of pigment ink, it does not take much time for the ink on the recording medium to dry due to its quick drying properties, but it takes time for water to penetrate into the recording medium, so that the difference in water content between the front side and the back side of the recording medium is great. Accordingly, curling is likely to occur due to the difference in water content between the front side and the back side of the recording medium. Therefore, if the recording medium becomes curled, because the ink dries quickly, the ink is cured while the recording medium remains curled.

If the curled medium is transported without being decurled, the medium may become jammed or be folded due to low discharge stability, resulting in reducing the quality of the printed medium.

If the liquid ejection type image forming apparatuses are configured to discharge sheets with their image sides down in the same manner as laser printers in order to arrange the output sheets in the same order as the original sheets (in the order of page number from the first page to the last page), because the ends of the sheets are curled upward, it is difficult to stack the curled sheets in a discharged sheet stacker compared to image forming apparatuses configured to discharge sheets with their printed sides up.

Moreover, the sheets are further curled after being discharged into the discharged sheet stacker.

These problems create a growing need for a solution to prevent curling of sheets and contamination of the sheets. In the case of the related-art techniques described above, while a sheet is held in a waiting mode to be decurled and dried, recording of the next sheet is not performed, so that the throughput decreases, resulting in reducing the productivity.

BRIEF SUMMARY

In an aspect of this disclosure, there is provided an image forming apparatus capable of preventing a reduction in the productivity with a simple configuration.

In another aspect, there is provided an image forming apparatus that has a recording head for ejecting droplets of recording liquid and forms an image on a recording medium. The image forming apparatus includes a decurling unit configured to perform decurling of the recording medium and adjusts the decurling of the recording medium based on a first information piece regarding the degree of curl of the recording medium and a second information piece regarding a subsequent recording medium on which an image is to be formed after the image is formed on the recording medium.

The aforementioned image forming apparatus is capable of reducing the degree of curl of a recording medium while preventing a reduction in the productivity with a simple configuration.

BRIEF DESCRIPTION OF THE DRAWINGS

FIG. 30 is a diagram schematically illustrating a transport device according to a twelfth embodiment of the present invention.

DETAILED DESCRIPTION OF THE PREFERRED EMBODIMENT

Figure 1:
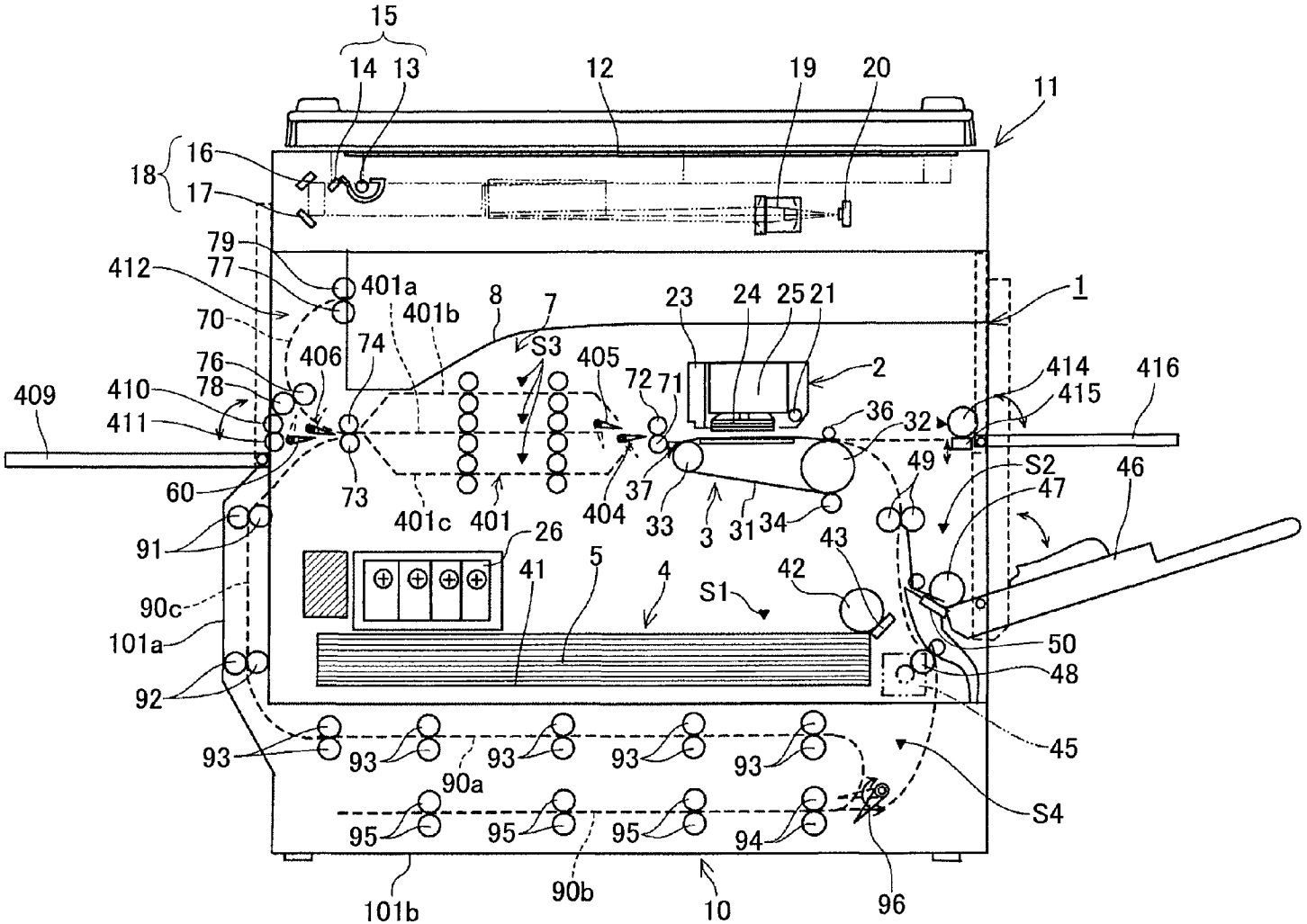
FIG. 1 is a schematic diagram illustrating an exemplary configuration of an image forming apparatus including a transport device according to a first embodiment of the present invention.
Figure 2:
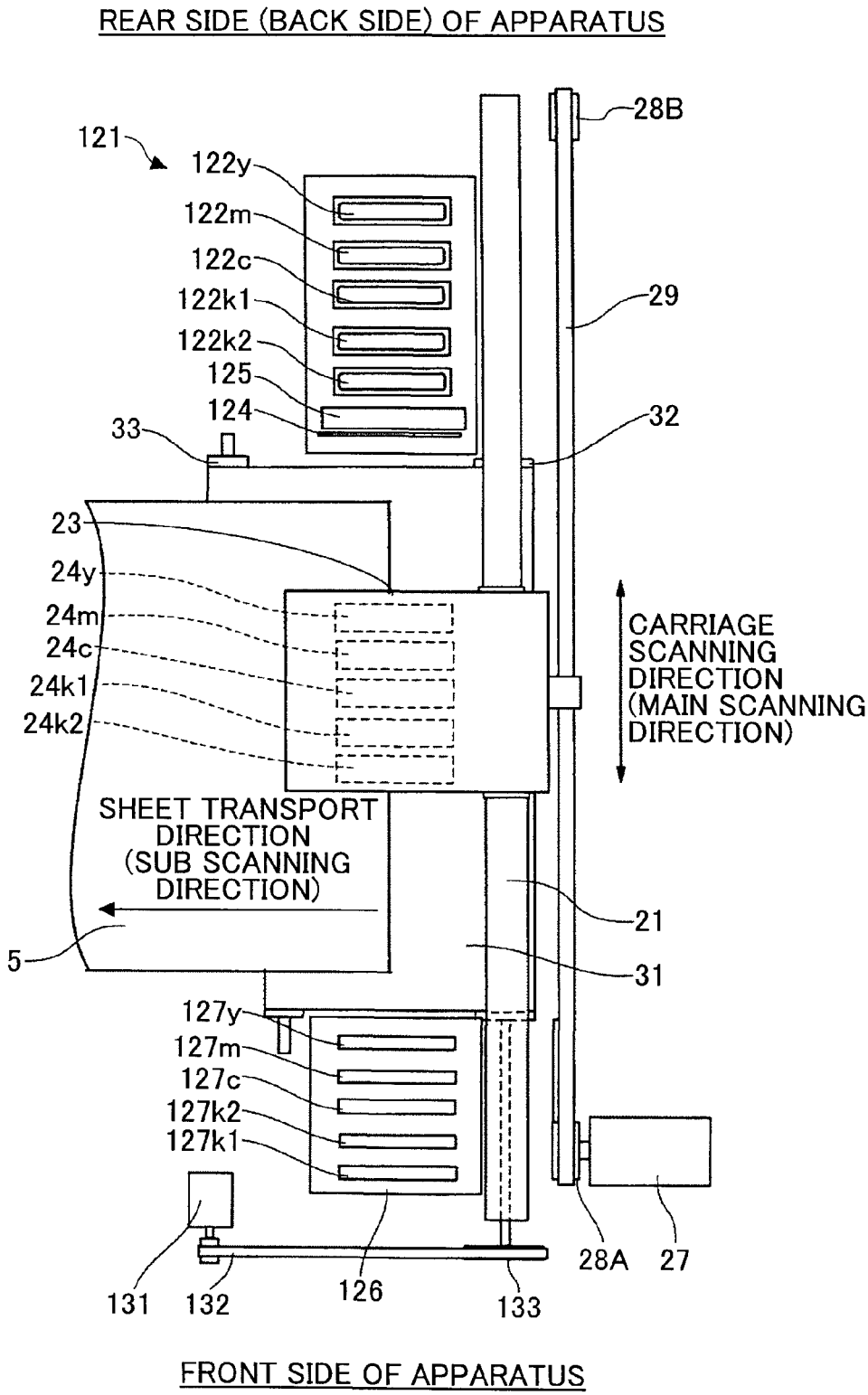
FIG. 2 is a plan view illustrating an image forming unit and a sub scanning transport unit of the image forming apparatus.
Figure 3:
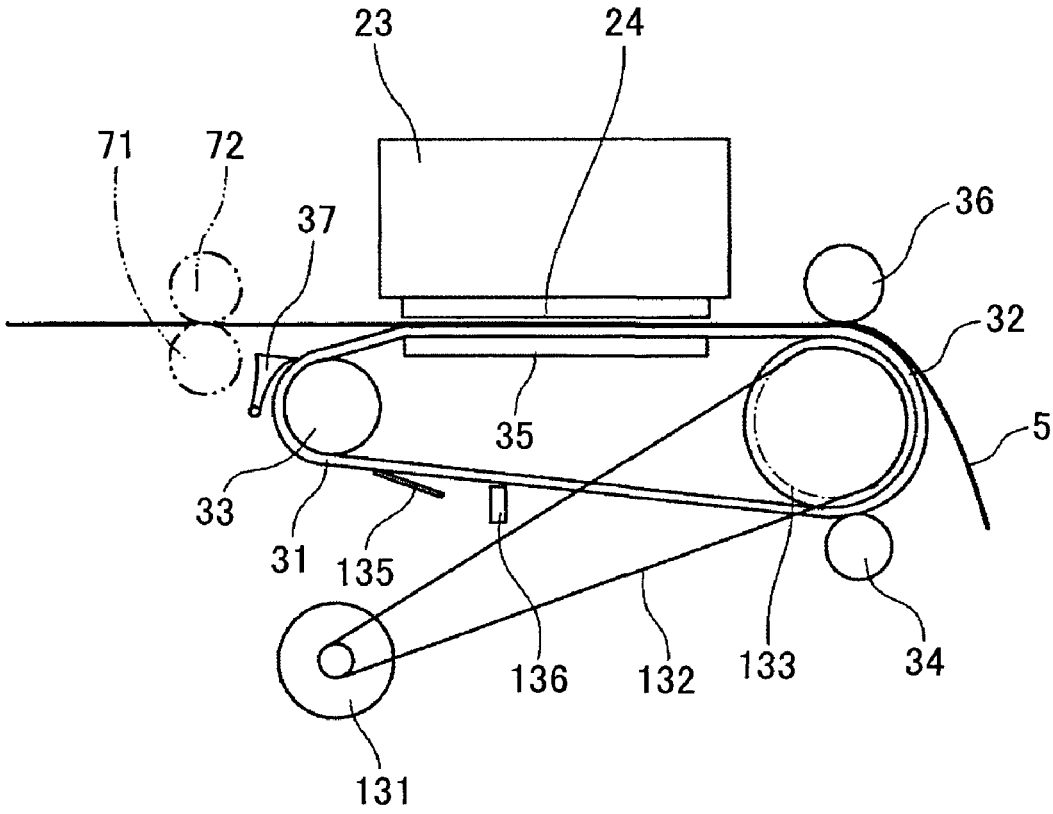
FIG. 3 is a schematic side view illustrating a part of the image forming apparatus.
Figure 4:
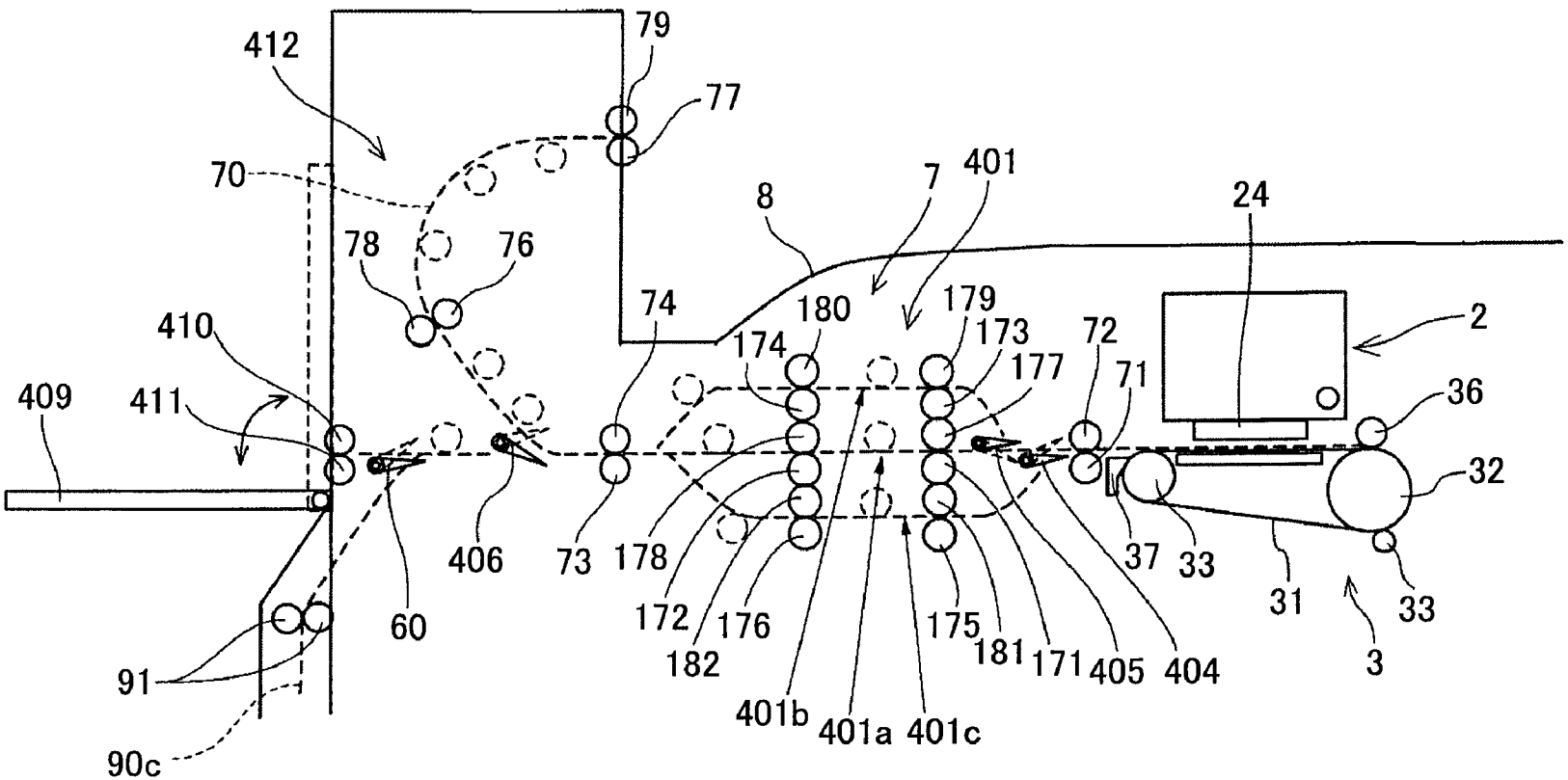
FIG. 4 is a schematic diagram illustrating the transport device of the image forming apparatus.

Exemplary embodiments of the present invention are described below with reference to the accompanying drawings. An example of an image forming apparatus according to a first embodiment of the present invention is described below with reference to FIGS. 1 through 4. FIG. 1 is a schematic diagram illustrating the configuration of the image forming apparatus. FIG. 2 is a plan view illustrating an image forming unit 2 and a sub scanning transport unit 3 of the image forming apparatus. FIG. 3 is a schematic side view illustrating a part of the image forming apparatus. FIG. 4 is a schematic diagram illustrating a transport unit 7.

The image forming apparatus includes, in an apparatus body 1, the image forming unit 2 that forms an image on a sheet (recording medium) 5 and the sub scanning transport unit 3 that transports the sheet 5. In the image forming apparatus, sheets 5 are fed one by one from a feed unit 4 disposed at the bottom of the apparatus body 1. The sheet 5 is transported by the sub scanning transport unit 3 to the position facing the image forming unit 2, at which an image is formed (recorded) on the sheet 5 by liquid droplets ejected from the image forming unit 2. Then, in the case of single-sided printing, the sheet 5 is ejected by the transport unit 7 onto a discharge tray 8 formed at the upper side of the apparatus body 1. In the case of duplex printing, the sheet 5 is transported to the middle of the transport unit 7, is fed to a duplexing unit 10 disposed at the bottom of the apparatus body 1, is switched back, and is fed again to the sub scanning transport unit 3. After an image is formed on the other side of the sheet 5, the sheet 5 is ejected onto the discharge tray 8.

The image forming apparatus further includes an image reading unit (scanner unit) 11 disposed above the discharge tray 8 in the apparatus body 1 and configured to read images. The image reading unit 11 serves as an image data (print data) input unit for reading image data, based on which an image is formed by the image forming unit 2.

The image reading unit 11 scans an image of the original document placed on a contact glass 12 by moving a first scanning optical unit 15 that includes a light source 13 and a mirror 14 and a second scanning optical unit 18 that includes mirrors 16, 17. The scanned image of the original document is read as image signals by an image reading element 20 disposed behind a lens 19. The read image signals are digitized and processed into print data to be printed out.

The image forming apparatus can receive, as image data (print data) to be formed by the image forming unit 2, print data including image data through a cable or a network from host devices, i.e., information processing devices such as external personal computers, image reading devices such as image scanners, and imaging devices such as digital cameras. The image forming apparatus can process and print out the received print data.

With reference to FIG. 2, in the image forming unit 2 of the image forming apparatus, a carriage 23 in which heads for different colors are arranged in the main scanning direction is movable in the main scanning direction and is held by a carriage guide (guide rod) 21 and a guide stay (not shown). The carriage 23 is moved in the main scanning direction by a main scanning motor 27 via a timing belt 29 extending around a drive pulley 28A and a driven pulley 28B.

The image forming unit 2 is a shuttle type. More specifically, while the carriage 23 in which a recording head 24 including the liquid droplet ejection heads that eject different colors of liquid droplets is mounted is reciprocally moved in the main scanning direction, the recording head 24 ejects liquid droplets and forms images on the sheet 5 being transported in a sheet transport direction (sub scanning direction) by the sub scanning transport unit 3.

A line type head in which the heads for different colors are arranged in the sub scanning direction may alternatively be used. The direction in which the heads are arranged, the order in which the heads for different color are arranged, and the direction of nozzle arrays of the heads are not limited to the illustrated embodiment and may be suitably selected.

The recording head 24 comprises five droplet ejection heads, namely, two droplet ejection heads 24*k*1 and 24*k*2 for ejecting a black (Bk) ink, and droplet ejection heads 24*c*, 24*m*, and 24*y* for ejecting a cyan (C) ink, a magenta (M) ink, and a yellow (Y) ink, respectively (hereinafter the droplet ejection heads are also referred to as "recording heads 24" when the colors are not referred to). The inks are supplied from corresponding sub tanks 25 (FIG. 1) mounted on the carriage 23.

Referring back to FIG. 1, ink cartridges 26 storing the black (Bk) ink, the cyan (C) ink, the magenta (M) ink, and the yellow (Y) ink, respectively, are detachably attached to a cartridge attachment section (not shown) from the front of the apparatus body 1. The inks in the ink cartridges 26 are supplied to the corresponding sub tanks 25. The black ink is supplied from the black ink cartridge 26 to the two black sub tanks 25.

The recording head 24 may be, but is not limited to, a piezo type that includes a pressure generating unit (actuator unit), which is used for applying pressure to ink in an ink passage (pressure generating chamber) and is configured to deform a wall of the ink passage so as to change the volume of the ink passage, thereby ejecting ink droplets; a thermal type configured to heat the ink in an ink passage using a heating element so as to form bubbles, thereby ejecting the ink with pressure of the bubbles; or an electrostatic type that includes a diaphragm on a wall of an ink passage and an electrode opposing the diaphragm, and is configured to deform the diaphragm with static electricity between the diaphragm and the electrode so as to change the volume of the ink passage, thereby ejecting ink droplets.

With reference to FIG. 2, a maintenance recovery device 121 for maintaining and restoring the condition of nozzles of the recording heads 24 is provided in a non-printing area located at one side in a scanning direction of the carriage 23. The maintenance recovery device 121 includes five dry-proof caps 122*k*2, 122*k*1, 122*c*, 122*m* and 122*y* (which are referred to as "dry-proof caps 122" when the colors are not referred to) for capping nozzle faces of the recording heads 24; a suction cap (not shown); a wiper blade 124 for wiping the nozzle faces of the recording head 24; and an idle ejection receiving member 125 for ejection (idle ejection) that does not contribute to recording (image formation).

Another idle ejection receiving member 126 for ejection (idle ejection) that does not contribute to recording (image forming) is provided in a non-printing area located at the other side in the scanning direction of the carriage 23. The idle ejection receiving member 126 has five openings 127*k*2, 127*k*1, 127*c*, 127*m*, and 127*y* (which are referred to as "openings 127" when the colors are not referred to) corresponding to the recording heads 24.

Referring also to FIG. 3, the sub scanning transport unit 3 includes a transport roller 32 as a drive roller for changing a transport direction of the sheet 5 sent from the lower side by 90 degrees such that the sheet 5 faces the image forming unit 2; a driven roller 33 as tension roller; an endless transport belt 31 extending around the transport roller 32 and the driven roller 33; a charging roller 34 as a charger that charges the surface of the transport belt 31 with a high voltage (alternating current) applied from a high-voltage power supply (AC bias supply unit); a guide member 35 that guides the transport belt 31 within an area opposing the image forming unit 2; a pressure roller 36 that presses the sheet 5 against the transport belt 31 at a position opposing the transport roller 32; and a separation claw 37 that separates the sheet 5 on which an image is formed from the transport belt 31.

The transport belt 31 of the sub scanning transport unit 3 is rotated to transport the sheet 5 in the sheet transport direction (sub scanning direction) indicated by the single-headed arrow shown in FIG. 2 when the transport roller 32 is rotated through a timing belt 132 and a timing roller 133 by a sub scanning motor 131. Although the transport belt 31 has a double layer structure including a front surface (sheet adhesion face) made of a pure resin material, such as pure ETFE material, with no resistance control, and a back side (middle resistance layer, grounding layer) made of the same material as the front layer but with resistance control by carbon, the transport belt 31 may have a single layer structure or a structure having three or more layers.

A cleaning unit 135 for removing paper powder and the like adhered to the surface of the transport belt 31 and a discharging brush 136 for discharging the surface of the transport belt 31 are provided between the driven roller 33 and the charging roller 34. The cleaning unit 135 used in the illustrated embodiment is made of Mylar (trademark).

The feed unit 4 includes a feed cassette 41 that is removable from the front of the apparatus body 1 and capable of storing a large number of sheets 5 in a stack; and a feed roller 42 and a friction pad 43 for feeding the sheets 5 one by one.

The feed unit 4 further includes a manual feed tray 46 rotatable between an open position shown by the solid line and a closed position shown by the dotted line; a manual feed roller 47 and a friction pad 50 for feeding the sheets 5 one by one from the manual feed tray 46; a straight manual feed tray 416 that is configured to store relatively rigid or inflexible sheets 5 (e.g., plastic materials such as CD, cardboard, and glossy paper) and is rotatable between a substantially horizontal open position shown by the solid line and a closed position shown by the dotted line; a straight manual feed roller 414 for feeding the sheet 5 from the straight manual feed tray 416; a friction pad 415 that is moved in the direction of arrows depending on the type of the sheets 5 and is configured to separate the sheets 5 from each other (for example, when feeding sheets 5 that are difficult to be separated from each other (e.g., plastic materials such as CD, metal materials, Japanese paper), the friction pad 415 is moved to separate the sheets 5 from each other; a transport roller 48 for transporting the sheet 5 fed from a feed cassette (not shown) that is optionally attached to the lower side of the apparatus body 1 or the duplexing unit 10; and a pair of transport rollers 49 for transporting the fed sheet 5 to the sub scanning transport unit 3.

Members for feeding the sheet 5 to the sub scanning transport unit 3, such the rollers 42, 47, 414 are driven by a feed motor (drive unit) 45, which is an HB stepping motor, via an electromagnetic clutch (not shown).

Referring also to FIG. 4, the transport unit 7 includes a transport roller 71 for transporting the sheet 5 separated by the separation claw 37 of the sub scanning transport unit 3; a spur 72 facing the transport roller 71; a switching plate 404 that is configured to switch the transport direction of the sheet 5 with an image formed as a material to be transported between a first transport path 401*a*/*a* second transport path 401*b* and a third transport path 401*c* and is rotatable between the position shown by the solid line and the position shown by the dotted line; a switching plate 405 that is configured to switch the transport direction of the sheet 5 between the first transport path 401*a* and the second transport path 401*b* and is rotatable between the position shown by the solid line and the position shown by the dotted line; transport rollers 171 and 172, 173 and 174, and 175 and 176, respectively on the first, second, and third transport paths 401*a*, 401*b*, and 401*c*; and spurs 177 and 178, 179 and 180, and 181 and 182 facing the transport rollers 171 and 172, 173 and 174, and 175 and 176, respectively. The rollers 171-176 and the corresponding spurs 177-182 nip the sheets 5 from the upper and lower sides. Because the spurs 177-182 are used on the plural transport paths 401, namely, the first-third transport paths 401*a*-401*c*, it is possible to transport the undried medium (the sheet 5 with an image formed) without contaminating the medium.

The first-third transport paths 401*a*-401*c* join together in front of a pair of transport rollers 73, 74. Because the plural paths join together in front of a predetermined transport destination in this way, component parts after the joining point can be commonly used, resulting in reducing the size, the number of component parts, and the cost of the apparatus.

The transport unit 7 further includes the pair of transport rollers 73, 74 for feeding the sheet 5 to a discharge and transport path 70, the duplexing unit 10, or a straight discharge tray 409 rotatable between an open position shown by the solid line and a closed position shown by the dotted lines; a switching plate 406 that is configured to switch the transport direction between the discharge and transport path 70 and the duplexing unit 10 (a vertical duplexing path 90*c*)/the straight discharge tray 409 and is rotatable between the position shown by the solid line and the position shown by the dotted line; a switching plate 60 that is configured to switch the transport direction between the duplexing unit 10 (the vertical duplexing path 90*c*) and the straight discharge tray 409 and is rotatable between the position shown by the solid line and the position shown by the dotted line; pairs of transport rollers 76, 78 and 77, 79 for transporting the sheet 5 to the discharge tray 8; and a pair of straight discharge rollers 410, 411 for transporting the sheet 5 to the straight discharge tray 409. The sheets 5 are discharged into the discharge tray 8 with the printed side down so that the sheets 5 that are printed in page number order are stacked in the page number order.

Spurs are preferably used as the rollers 74, 76, 77, 410 in order to prevent contamination of the sheet 5 due to use of rollers. Spurs are preferably provided in positions not facing the transport rollers, for example, but not limited to the positions shown by the dotted lines in order to prevent the printed side of the sheet 5 from coming in contact with a transport guide (not shown) and to prevent contamination of the sheet 5.

The switching plate 404 is rotatable between the position shown by the solid line and the position shown by the dotted line to switch, downstream of the transport roller 71, the transport direction of the sheet 5 transported from upstream between the direction of the first transport path 401*a*/the second transport path 401*b* and the direction of the third transport path 401*c*. When in the position shown by the solid line, the switching plate 404 guides the sheet 5 to the first transport path 401*a* on which the transport rollers 171, 172 and the spurs 177, 178 are disposed/the second transport path 401*b* on which the transport rollers 173 and 174 and the spurs 179 and 180 are disposed. When in the position shown by the dotted line, the switching plate 404 guides the sheet 5 to the third transport path 401*c* on which the transport rollers 175, 176 and the spurs 181, 182 are disposed.

The switching plate 405 is rotatable between the position shown by the solid line and the position shown by the dotted line to switch, downstream of the transport roller 71, the transport direction of the sheet 5 transported from upstream between the first transport path 401*a* and the second transport path 401*b*. When in the position shown by the solid line, the switching plate 405 guides the sheet 5 to the first transport path 401*a* on which the transport rollers 171, 172 and the spurs 177, 178 are disposed. When in the position shown by the dotted line, the switching plate 405 guides the sheet 5 to the second transport path 401*b* on which the transport rollers 173, 174 and the spurs 179, 180 are disposed.

The integrally formed duplexing unit 10 includes a vertical transport unit 101*a* forming a vertical duplexing path 90*c*, which receives the sheet 5 guided by the switching plates 406 and 60 from the side of the apparatus body 1 and transports the sheet 5 downward; and a horizontal transport unit 101*b* forming a horizontal loading path 90*a*, which transports the sheet 5 in the horizontal direction from the vertical duplexing path 90*c*, and a switchback path 90*b*.

A pair of duplexing entrance rollers 91 for transporting the fed sheet 5 downward and a pair of transport rollers 92 for feeding the sheet 5 to the horizontal loading path 90*a* are provided on the vertical duplexing path 90*c*. Five pairs of duplexing transport rollers 93 are provided on the horizontal loading path 90*a*. A pair of duplexing exit rollers 94 and three pairs of duplexing transport rollers 95, which are reverse rollers for reversing and re-feeding the sheet 5 fed from the horizontal loading path 90*a*, are provided on the switchback path 90*b*.

The duplexing unit 10 includes a switching plate 96 that is rotatable and configured to switch between a path of the sheet 5 from the horizontal loading path 90*a* to the switchback path 90*b* and a path of the sheet 5 from the switchback path 90*b* to the transport roller 48 for re-feeding the sheet 5. The switching plate 96 is rotatable between a switchback position shown by the solid line and a re-feeding position shown by the dotted line in FIG. 1.

The switching plate 406 is rotatable between a discharge position shown by the solid line and a duplexing position shown by the dotted line in FIG. 1 and is configured to switch the transport direction of the sheet 5 downstream of the pair of discharge rollers 73, 74 between the direction of the discharge tray 8 and the direction of the duplexing unit 10/the straight discharge tray 409. When in the discharge position, the switching plate 406 guides the sheet 5 toward the pair of transport rollers 76, 78 and 77, 79. When in the duplexing position, the switching plate 406 guides the sheet 5 in the direction of the straight discharge tray 409/the pair of duplexing entrance rollers 91.

The switching plate 60 is rotatable between a discharge position shown by the solid line and a duplexing position shown by the dotted line in FIG. 1 and is configured to switch the transport direction of the sheet 5 between the direction of the straight discharge tray 409 and the duplexing unit 10. When in the discharge position, the switching plate 60 guides the sheet 5 toward the pair of discharge rollers 410, 411. When in the duplexing position, the switching plate 60 guides the sheet 5 toward the pair of duplexing entrance rollers 91.

Although not shown, an image start sensor for detecting the leading edge of the sheet 5 and an image end sensor for detecting the trailing edge of the sheet 5 are disposed upstream and downstream, respectively, in the sheet transport direction in the image forming unit 2.

Figure 5:
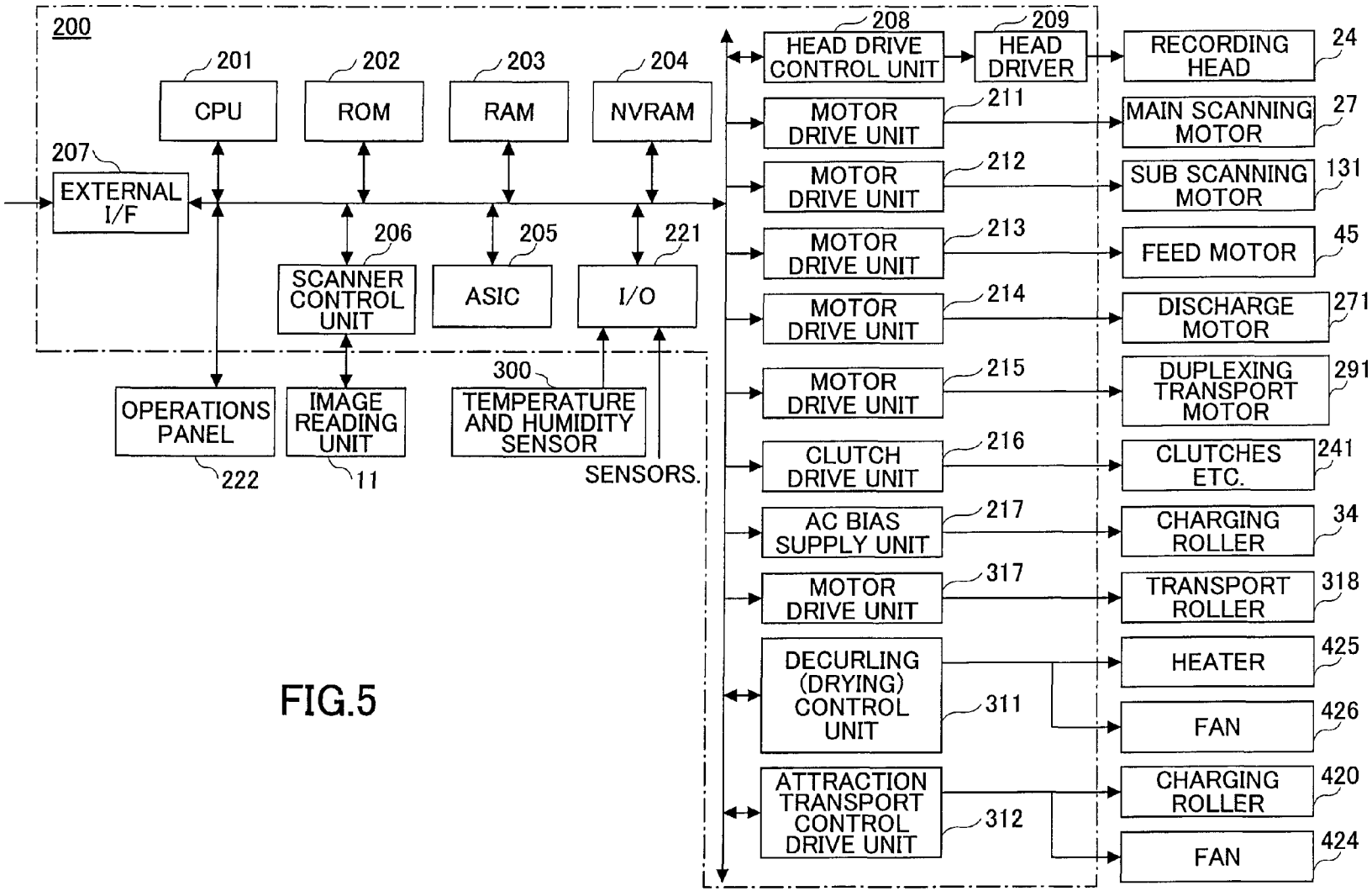
FIG. 5 is a functional block diagram illustrating a control unit of the image forming apparatus.

An overview of a control unit 200 of the image forming apparatus is described below with reference to FIG. 5. FIG. 5 is a block diagram schematically illustrating the control unit 200.

The control unit 200 includes a CPU 201 that controls the entire image forming apparatus; a ROM 202 that stores programs executed by the CPU 201 and other fixed data, a RAM 203 that temporarily stores image data (print data) and the like; a nonvolatile memory (NVRAM) 204 that retains data even when the power to the apparatus is turned off; an ASIC 205 that processes various signals for image data and processes input/output signals for processing or reordering images and for controlling the entire apparatus; and a scanner control unit 206 that causes the image reading unit 11 to read images and processes the read images.

The control unit 200 further includes an external I/F 207 for receiving data and signals from and sending data and signals to external devices; a head drive control unit 208 and a head driver 209 for controlling and driving the recording head 24 of the image forming unit 2; and motor drive units 211-215 and 317 including motor drivers, for independently driving motors (drive sources). The motor drive unit 211 drives the main scanning motor 27 for moving the carriage 23 in the main scanning direction. The motor drive unit 212 drives the sub scanning motor 131 for rotating the transport belt 31 by rotating the transport roller 32. The motor drive unit 213 drives the feed motor 45. The motor drive unit 214 drives a discharge motor 271 for driving rollers on the discharge and transport path 70. The motor drive unit 215 drives a duplexing transport motor 291 for driving rollers of the duplexing unit 10. The motor drive unit 317 drives a transport motor 318 for driving rollers (on the transport paths 401) of the transport unit 7.

The control unit 200 further includes a clutch drive unit 216 that drives an electromagnetic clutch for independently driving the feed rollers 42, 47, and 414, an electromagnetic clutch for independently driving the first, second, and third transport paths 401*a*, 401*b*, and 401*c*, a switching plate solenoid for turning the switching plate 404 between the direction of the third transport path 401*c* and the direction of the first/second transport paths 401*a* and 401*b*, a switching plate solenoid for turning the switching plate 405 between the direction of the first transport path 401*a* and the direction of the second transport path 401*b*, a switching plate solenoid for turning the switching plate 60 between the straight discharge position and the duplexing position, and a switching plate solenoid for turning the switching plate 96 between the switchback position and the re-feeding position (these clutches and solenoids are hereinafter collectively called "clutches, etc. 241"); an AC bias supply unit 217 that applies AC bias voltage (high voltage) to a charging roller 420; a decurling (drying) control unit 311 that drives a heater 425 for heating the sheet 5 on the waiting and transport path 70 and a fan 426 as an air current generating unit for generating a hot or cool air current to dry the sheet 5 on the transport paths 401; and an attraction transport control drive unit 312 that causes the charging roller 420 to electrostatically attract the sheet 5 by applying AC bias voltage (high voltage) to the charging roller 420 or causes a suction fan 424 to attract the sheet 5 by air suction.

The control unit 200 further includes an I/O 221 that receives detection signals from a temperature and humidity sensor 300 for detecting temperature and humidity as environmental conditions, and various other sensors (not shown) such as the image start sensor and the image end sensors. An operations panel 222 for inputting and displaying information necessary for the apparatus is connected to the control unit 200.

The temperature and humidity sensor 300 for detecting temperature and humidity is disposed at least at one of positions S1-S4 of FIG. 1. If the temperature and humidity sensor 300 is disposed in the position S1 near the feed cassette 41 for stacking the sheets 5 as recording media (materials to be transported), because the temperature and the humidity around the sheets 5 to be fed can be determined, the water content in the sheets 5 to be fed can be detected. Therefore, it is possible to perform curling prevention control at higher accuracy. If plural temperature and humidity sensors 300 are disposed in the position S3 of the transport unit 7 where the sheet 5 as the recording medium on which image is formed by the recording head 24 is passed through, because the temperature and the humidity around the sheet 5 on which image is formed can be detected, the dryness of the sheet 5 on which the image is formed can be detected. Therefore, it is possible to perform curling prevention control at higher accuracy.

The temperature and humidity sensor 300 may be disposed in the position S2 to detect the temperature and humidity around the sheet 5 fed from the feed cassette 41 or the like, or in the position S4 to detect the temperature and humidity around the sheet 5 to be re-fed for duplex printing.

The control unit 200 processes an image of the original document read by the image reading unit 11 and loads the processed image into a buffer of the scanner control unit 206. Further, the control unit 200 receives print data or the like from external host devices such as information processing apparatuses (e.g., personal computers) and imaging devices (e.g., digital cameras) via the external I/F 207 and loads the received data into a receiving buffer of the external I/F/ 207.

The CPU 201 reads image data from the scanner control unit 206 and the external I/F 207, analyzes the read image data, causes the ASIC 205 to perform necessary image processing and data reordering, and sends print image data to the head drive control unit 208. Dot pattern data for outputting images based on external data may be generated using font data stored in the ROM 202, for example. Alternatively, image data may be expanded into bit map data by a printer driver of an external host device before being transmitted to the image forming apparatus.

When the head drive control unit 208 receives image data (dot pattern data) for one line of each recording head 24, the dot pattern data for one line are transmitted to the head driver 209. The head driver 209 drives an actuator unit of each recording head 24 by selectively applying a required drive waveform to the actuator unit, and thus causes required nozzles of each recording head 24 to eject liquid droplets.

In the image forming apparatus with this configuration, the sheets 5 are fed from the feed unit 4 or the duplexing unit 10 one by one. Then the sheet 5 is pressed against the transport belt 31 by the pressure roller 36 so that the transport direction is rotated about 90 degrees. The sheet 5 is electrostatically attracted by the transport belt 31 and is transported in the sub scanning direction by rotational movement of the transport belt 31.

The recording heads 24 are driven according to image signals to eject ink droplets onto the sheet 5 not in motion while the carriage 23 is moved. After one line is recorded, the sheet 5 is transported by a distance corresponding to one line. Then the next line is recorded. In this way, the sheet 5 is intermittently transported, so that an image is formed on the sheet 5.

The recording operation ends upon receiving a recording completion signal or a signal indicting that the trailing edge of the sheet 5 has reached a recording area.

After that, as described below, a waiting operation is performed for decurling the sheet 5 and drying ink in one of the first, second, or the third transport paths 401*a*, 401*b*, or 401*c*. Then, the sheet 5 is fed to the transport destination, which may be the discharge tray 8, the straight discharge tray 409, or the duplexing unit 10.

Figure 6:
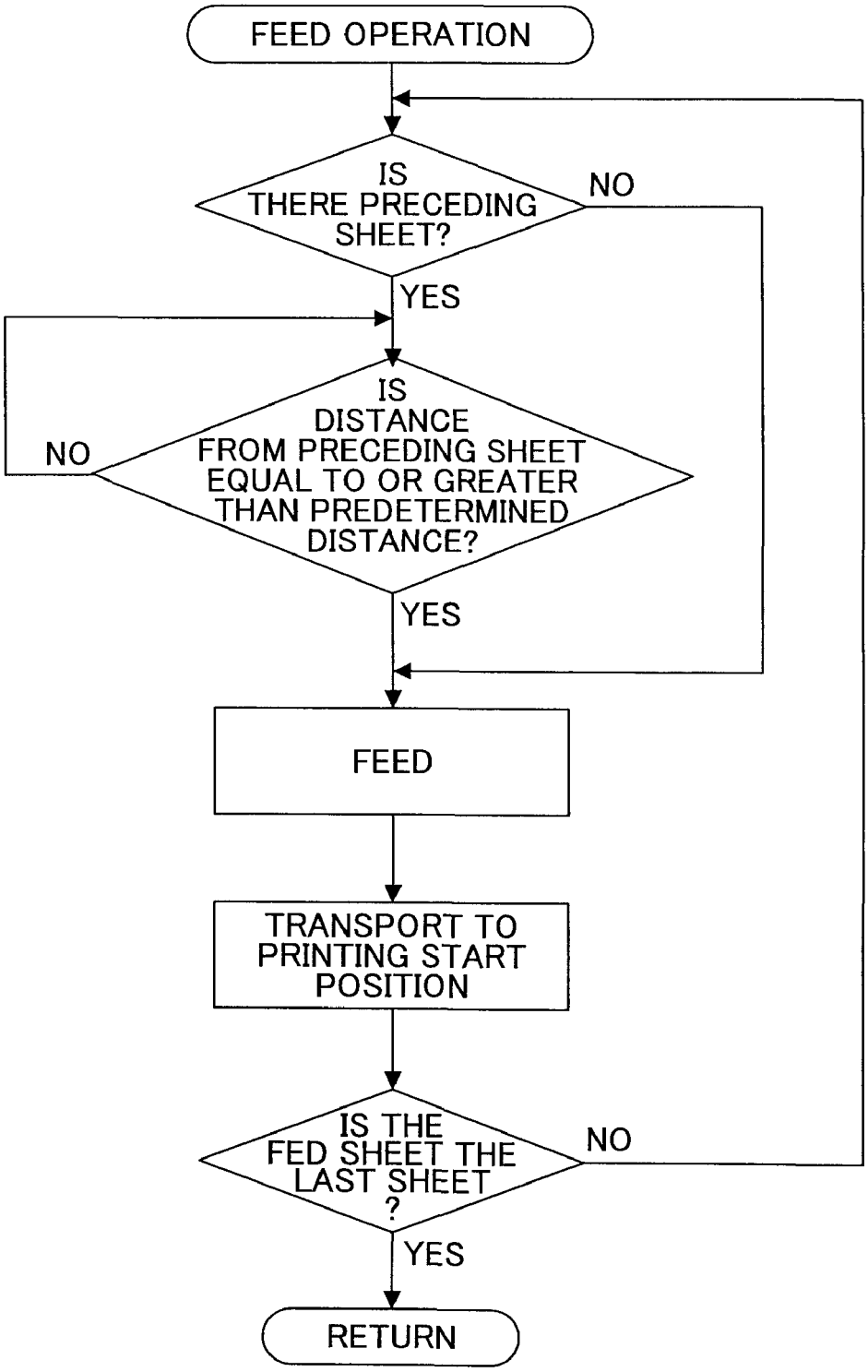
FIG. 6 is a flowchart illustrating a feeding operation performed by the control unit.
Figure 7:
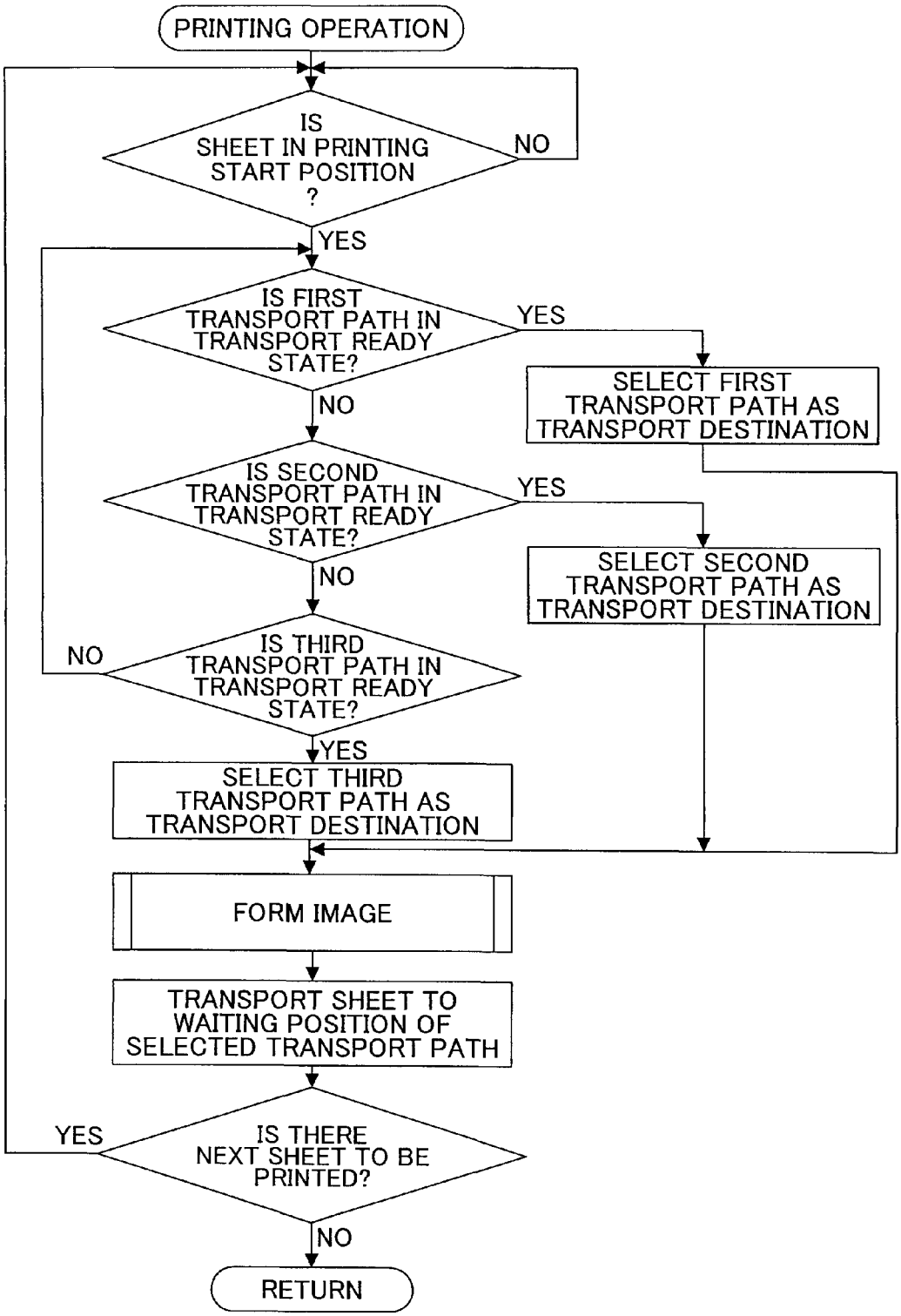
FIG. 7 is a flowchart illustrating a printing operation performed by the control unit.
Figure 8:
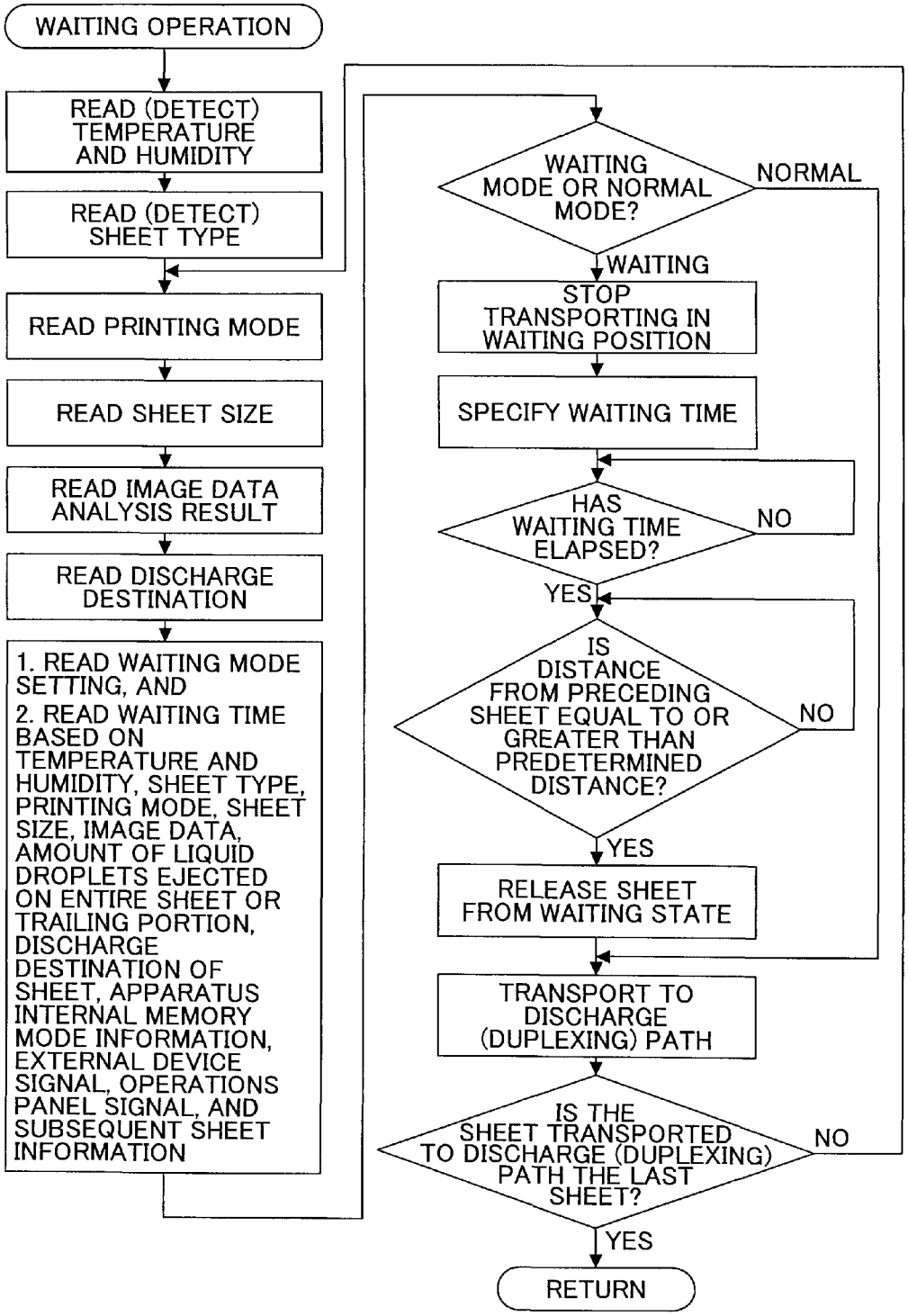
FIG. 8 is a flowchart illustrating a waiting operation performed by the control unit.

The waiting operation for decurling (also referred to as "drying") the sheet 5 in the image forming apparatus of the first embodiment of the present invention having the above-described configuration is described referring also to flowcharts of FIGS. 6-8.

First, upon starting printing, as shown in FIG. 6, a feed operation for feeding the sheets 5 one by one from the feed cassette 41 of the feed unit 4 to a printing start position of the sub scanning transport unit 3 is started by driving the feed motor 45 and a feed clutch (not shown). If there is a next sheet 5 to be fed, the position of the trailing edge of the preceding sheet 5 is determined by calculating the transport distance of the preceding sheet 5 from a sheet edge detection sensor (not shown), until it is determined that the distance from the preceding sheet 5 is equal to a predetermined distance (e.g., 60 mm). If the distance from the preceding sheet 5 becomes equal to the predetermined distance, the next sheet 5 is transported to the printing start position. In this way, the sheets 5 are continually fed to the printing start position of the sub scanning transport unit 3 while maintaining the predetermined distance between the sheets 5 until the last sheet 5 to be fed is fed.

Then in a printing operation, as shown in FIG. 7, when the sheet 5 is fed to the printing start position, it is determined whether there is a preceding sheet 5 in any one of the first, second, and third transport paths 401*a*, 401*b*, and 401*c* of FIG. 4 or it is determined whether the preceding sheet 5 has been released from a waiting mode even if there is a preceding sheet 5. If one or more of the first, second, and third transport paths 401*a*, 401*b*, and 401*c* do not have a preceding sheet 5 or have a preceding sheet 5 but the preceding sheet 5 is released from being held in the waiting mode (this condition of the transport path is hereinafter called a "sheet transport ready state"), the sheet 5 is transported to the appropriate one of the transport paths 401*a*, 401*b*, and 401*c*.

More specifically, it is determined whether the first transport path 401*a* is in the sheet transport ready state. If the first transport path 401*a* is in the sheet transport ready state, the first transport path 401*a* is selected as the transport destination. On the other hand, if the first transport path 401*a* is not in the sheet transport ready state, it is determined whether the second transport path 401*b* is in the sheet transport ready state. If the second transport path 402*a* is in the sheet transport ready state, the second transport path 401*b* is selected as the transport destination. On the other hand, if the second transport path 401*b* is not in the sheet transport ready state, it is determined whether the third transport path 401*c* is in the sheet transport ready state. If the third transport path 401*c* is in the sheet transport ready state, the third transport path 401*c* is selected as the transport destination. On the other hand, if the third transport path 401*c* is not in the sheet transport ready state, i.e., if none of the first, second and third transport paths 401*a*, 401*b*, and 401*c* is in the sheet transport ready state, these operations are repeated until any one of the first, second and third transport paths 401*a*, 401*b*, and 401*c* is in the sheet transport ready state.

Thus, the sheet 5 is transported through one of the first, second, and third transport paths 401*a*, 401*b*, and 401*c* having priority in this order. Therefore, when a waiting mode is not selected, the straight first transport path 401*a* which has the shortest transport distance and allows transporting relatively hard sheets 5 is selected. If the sheet waiting time is relatively short, only the first and second transport paths 401*a* and 401*b* are used. Therefore, in the case of recovering from apparatus problems such as jamming, the sheet 5 causing the problem can easily be removed.

According to this embodiment, although not illustrated, in the case where the sheet 5 is jammed, the discharge tray 8 is opened for removal of the jammed sheet 5. If the sheet 5 is jammed in the second transport path 401*b*, the jammed sheet can easily be removed from the opened discharge tray 8. Therefore, the second transport path 401*b* disposed at the upper side has the second priority after the straight first transport path 401*a*.

The transport path selection criteria are not limited to the criteria described above. For example, the first and second transport paths 401*a* and 402*b* are alternately used even if no waiting time is applied such that the printed sheet 5 and the next sheet 5 to be printed are transported independently from each other. Especially, because the shuttle type image forming apparatuses intermittently transport (repeatedly start and stop transporting) the sheets 5 during printing, if the same transport path is used, transport of the preceding sheet 5 is repeatedly started and stopped. If the sheet 5 being discharged is intermittently transported, the sheet 5 may be folded so that it cannot be smoothly discharged.

To avoid such a problem, transport path switching control may be used. More specifically, the current sheet 5 and the next sheet 5 may be transported through different transport paths to transport the current printed sheet 5 and the next sheet 5 being printed independently from each other, thereby transporting the current sheet 5 to the discharge and transport path 70 and discharging the current sheet 5 without stopping the current sheet 5 even if the next sheet 5 is being printed.

When one of the first, second, and third transport paths 401*a*, 401*b*, and 401*c* is selected as described above, an image forming (printing) operation for forming an image on the sheet 5 is performed while moving the recording heads 24 and the sheet 5 in the main scanning direction and the sub scanning direction, respectively. Then, the sheet 5 on which an image is formed by the printing operation is fed to one of waiting positions of the first, second, and third transport paths 401*a*, 401*b*, and 401*c*. If there is a next sheet 5 to be printed, this operation is continuously performed.

Next, a waiting operation is described below with reference to FIG. 8.

First, when a printing operation is completed and the sheet 5 on which an image is formed is transported to the selected one of the transport positions of the first, second, third transport paths 401*a*, 401*b*, and 401*c*, various setting conditions are read including a first information piece about the degree of the curl of the printed sheet 5 (the temperature and humidity, the type of the sheet, the printing mode, the sheet size, image data, the amount of liquid droplets ejected on the entire sheet or the trailing portion as a predetermined area of the sheet, and the discharge destination of the sheet); a second information piece about whether there are sheets 5 (hereinafter also referred to as "subsequent sheets 5") to be printed following the printed sheet 5, including an information piece about the number of the subsequent sheets 5, and an information piece about the degree of curls of the subsequent sheets 5 (the temperature and humidity, the type of the sheet, the printing mode, the sheet size, image data, the amount of liquid droplets ejected on the entire sheet or the trailing portion as a predetermined area of the sheet, and the discharge destination of the sheet); and a mode setting information piece (an apparatus internal memory mode signal, an external device mode signal, and an operations panel mode signal). Then either a waiting mode or a normal mode is selected based on a combination of these conditions as described below in greater detail. As described below, the subsequent sheets (subsequent recording media) 5 include not only sheets 5 for the same print job but also sheets 5 for a different print job.

Information indicating the relationships between the various setting conditions and the modes may be stored in a table format in the nonvolatile memory (NVRAM) 204 in advance. The stored information is read from the nonvolatile memory 204 upon selecting the mode based on the various setting conditions. The mode selection condition stored in the nonvolatile memory (NVRAM) 204 used for selecting the mode may be entered by a user of the image forming apparatus using the operations panel 222 or using a printer driver of a host device and may preferably be alterable.

If the normal mode is selected, the sheet 5 is transported downstream to the discharge destination (the discharge and transport path 70 or the duplexing path 90*c*) without being stopped.

If the waiting mode is selected, transport of the sheet 5 is stopped in the waiting position of one of the first, second, third transport paths 401*a*, 401*b*, and 401*c* to which the sheet 5 is fed. Then, as described below in detail, the waiting time is specified based on the various setting conditions including the information piece about the degree of the curl of the printed sheet 5 (the temperature and humidity, the type of the sheet, the printing mode, the sheet size, image data, the amount of liquid droplets ejected on the entire sheet or the trailing portion as a predetermined area of the sheet, the discharge destination of the sheet), the information piece about whether there are the subsequent sheets 5 to be printed following the printed sheet 5, the information piece about the number of the subsequent sheets 5, and the information piece about the degree of the curls of the subsequent sheets 5 (the temperature and humidity, the type of the sheet, the printing mode, the sheet size, image data, the amount of liquid droplets ejected on the entire sheet or the trailing portion as a predetermined area of the sheet, the discharge destination of the sheet), and the mode setting information piece (an apparatus internal memory mode signal, an external device mode signal, and an operations panel mode signal).

Information indicating the relationships between the various setting conditions and the waiting time may be stored in a table format in the nonvolatile memory (NVRAM) 204 in advance. The stored information is read from the nonvolatile memory 204 upon specifying waiting time based on the various setting conditions. The mode selecting condition stored in the nonvolatile memory (NVRAM) 204 used for specifying the waiting time may be entered by a user of the image forming apparatus using the operations panel 222 or using a printer driver of a host device and may preferably be alterable.

The sheet 5 with the specified waiting time remains in the waiting position until the waiting time has passed. When the waiting time has passed, it is determined whether the distance from the preceding sheet 5 is equal to or greater than the setting value (e.g., 20 mm). The position of the trailing edge of the preceding sheet 5 is determined by calculating the transport distance of the preceding sheet 5 from the sheet edge detection sensor (not shown). This prevents the order of the sheets 5 from being altered and prevents the sheet 5 from being jammed or folded due to collision with the preceding sheet 5 even if different waiting times are specified for the sheets 5.

If the distance from the preceding sheet 5 is equal to or greater than the setting value, the sheet 5 is released from the waiting mode and is transported to the transport destination (the discharge and transport path 70 or the duplexing path 90*c*). At the same time, as mentioned above with reference to FIG. 7, this transport path is enabled to transport the next sheet 5. Thus, the next sheet 5 to be printed can be transported before the sheet 5 in the specified transport path 401 is transported completely out of the transport path 401. This improves the productivity.

Next, the above-described waiting operation is described below in greater detail with reference also to FIGS. 9-14. FIGS. 9-14 are diagrams illustrating the flow of the sheets 5 in the case where the waiting mode is selected. In this example, the first, second, and third transport paths 401*a*, 401*b*, and 401*c* are used.

When the three transport paths 401*a*, 401*b*, and 401*c* are used to transport the sheets 5, the waiting operation for decurling and drying the sheets 5 can be performed. The transport paths 401 to be used are not limited to the transport paths 401 used in the illustrated example. For example, in the case where the waiting time is relatively short or in the case where a smaller number of the transport paths 401 are provided, a combination of the first and second transport paths 401*a* and 401*b*, a combination of the first and third transport paths 401*a* and 401*c*, or a combination of the second and third transport paths 401*b* and 401*c* may be used. In an alternative embodiment, three or more transport paths 401 may be provided to allow longer waiting time.

This example illustrates an operation of transporting five sheets 5 (5A, 5B, 5C, 5D, and 5E). In the transport unit 7 having the configuration described with reference to FIG. 4, waiting position sensors 420 for detecting the waiting positions of the sheets 5 are disposed on the first, second, third transport paths 401*a*, 401*b*, and 401*c*. The method of detecting the position of the sheet 5 is not limited to the detection method using the illustrated waiting position sensors 420. For example, the position of the sheet 5 may be determined by calculating the transport distance of the sheet 5 from any sensor (not shown). The components such as the switching plates 404 and 405 corresponding to the components illustrated in FIG. 4 are denoted by the same reference numerals and are not described in detail here.

Figure 9:
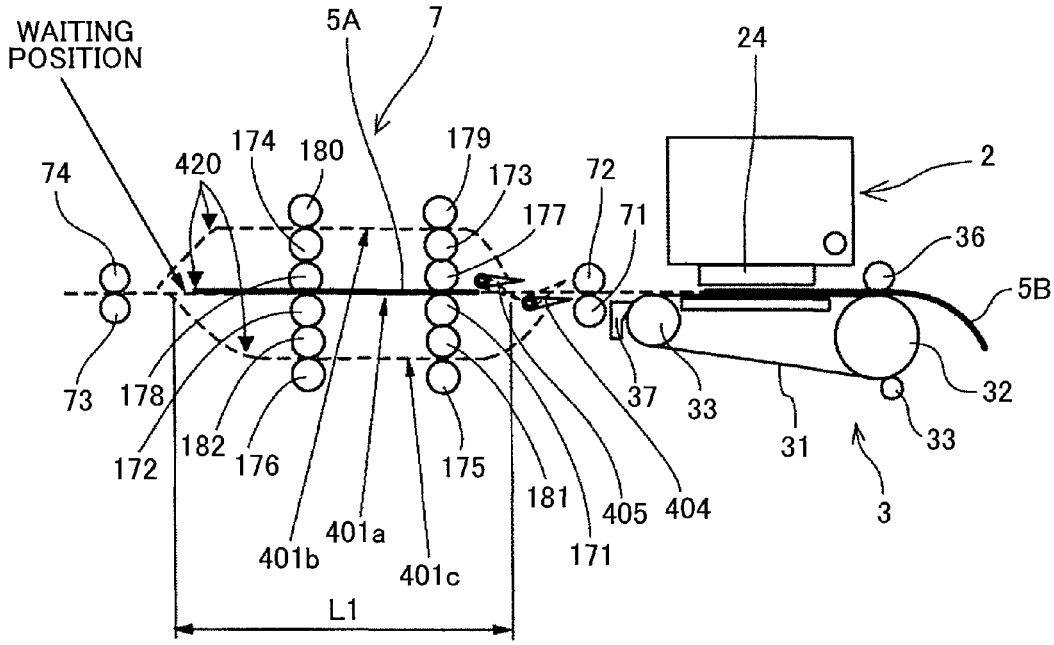
FIG. 9 is a schematic diagram illustrating the statuses of first and second sheets during a waiting operation.

First, as shown in FIG. 9, when the leading edge of the printed sheet 5A is detected by the waiting position sensor 420, the sheet 5A is stopped in the waiting position of the first transport path 401*a* and the operation waits for the waiting time to pass. The next sheet 5B is stopped in the printing start position. In this step, because there are no sheets 5 on the second and third transport paths 401*b* and 401*c*, the second transport path 401*b* is specified as the transport path for transporting the sheet 5B in the same manner as described above.

Figure 10:
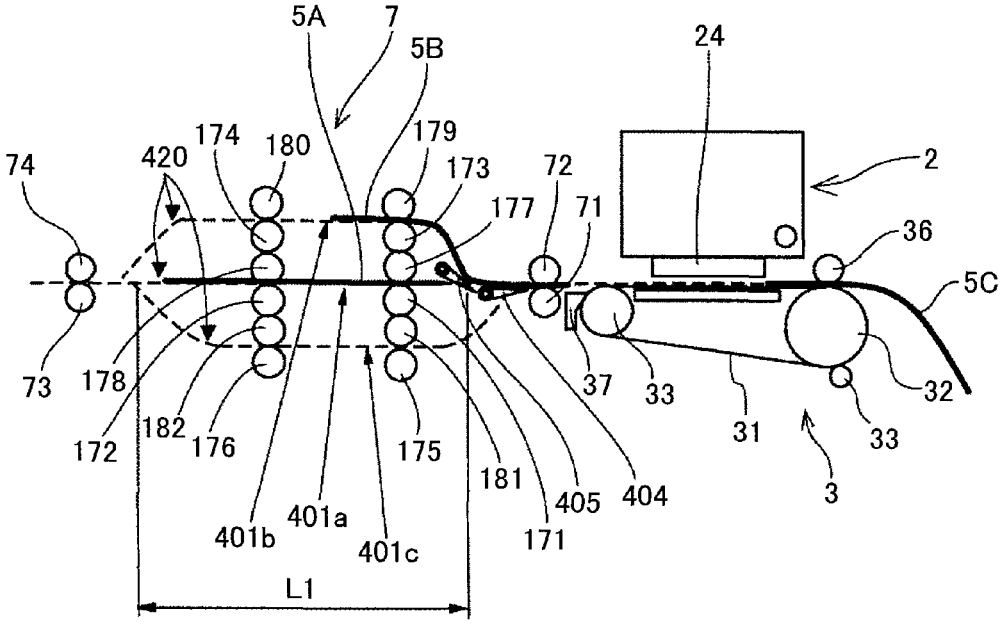
FIG. 10 is a schematic diagram illustrating the statuses of first through third sheets.

Then, as shown in FIG. 10, the sheet 5B is fed and transported to the second transport path 401*b*. The sheet 5C is transported to the printing start position with a predetermined distance (e.g., 60 mm) from the sheet 5B.

Figure 11:
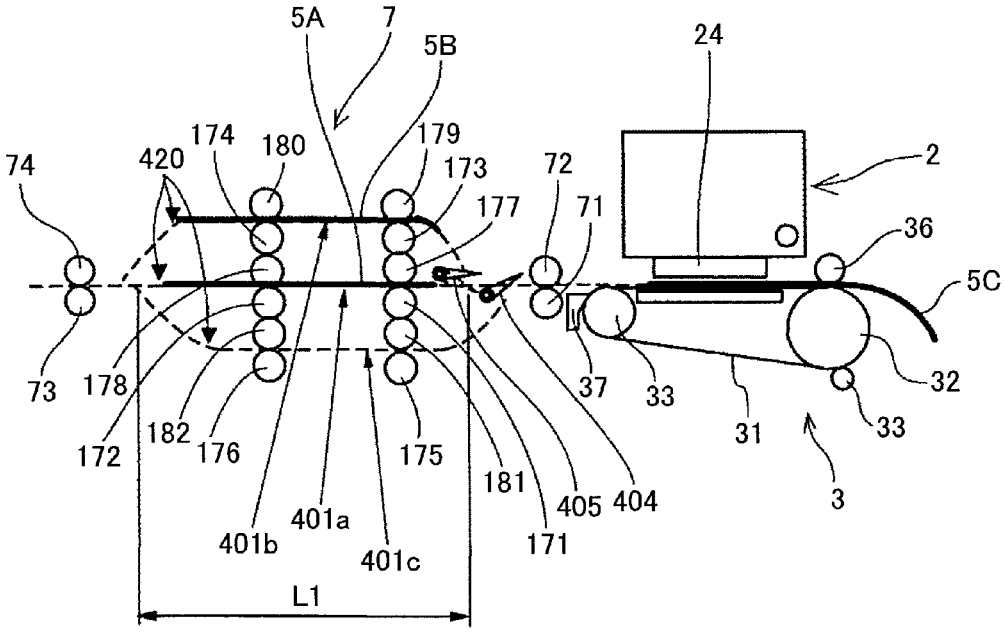
FIG. 11 is a schematic diagram illustrating the next statuses of the first through third sheets.

Then, as shown in FIG. 11, when the leading edge of the printed sheet 5B is detected by the waiting position sensor 420, the sheet 5B is stopped in the waiting position of the second transport path 401*b* and the operation waits for the waiting time to pass. The next sheet 5C is stopped in the printing start position. In this step, the third transport path 401*c* is specified as the transport path for transporting the sheet 5C in the same manner as described above.

Figure 12:
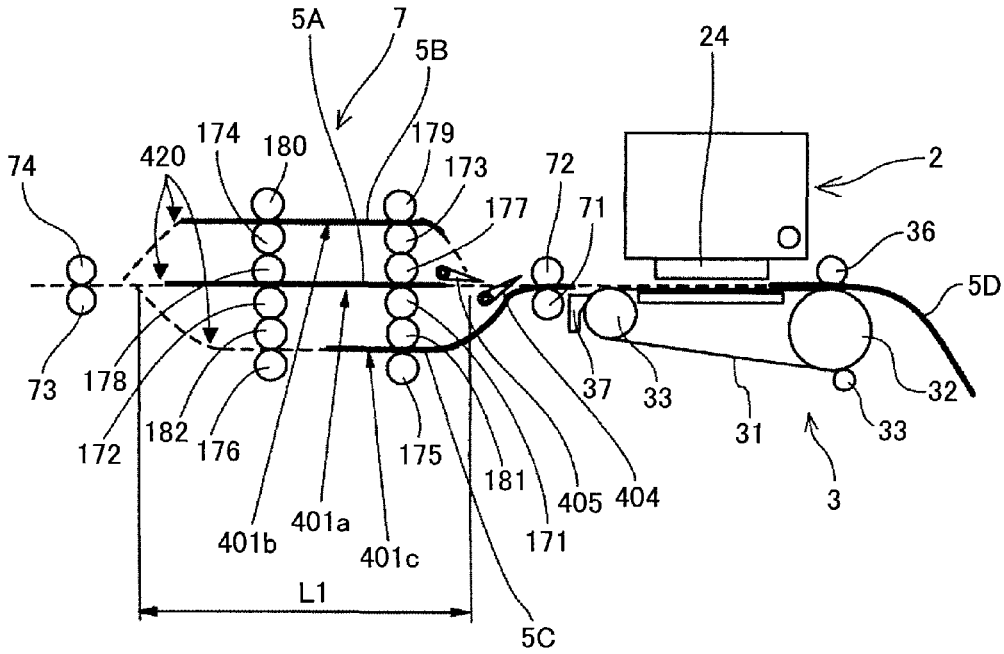
FIG. 12 is a schematic diagram illustrating the statuses of first through fourth sheets.

Then, as shown in FIG. 12, the sheet 5C is fed and transported to the third transport path 401*c*. The sheet 5D is transported to the printing start position with a predetermined distance (e.g., 60 mm) from the sheet 5C.

Figure 13:
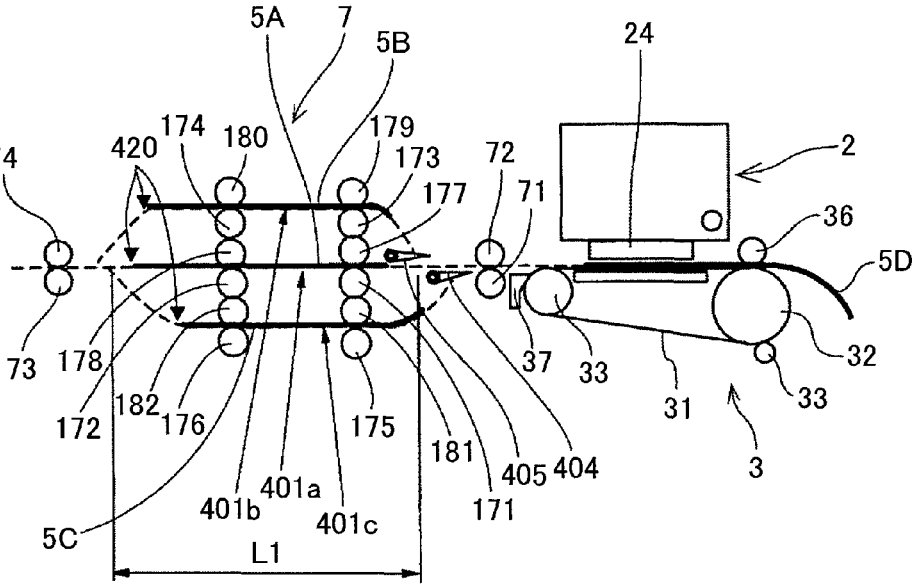
FIG. 13 is a schematic diagram illustrating the next statuses of the first through fourth sheets.

Then, as shown in FIG. 13, when the leading edge of the printed sheet 5C is detected by the waiting position sensor 420, the sheet 5B is stopped in the waiting position of the third transport path 401*c* and the operation waits for the waiting time to pass. The next sheet 5D is stopped in the printing start position. In this step, because there are sheets 5 in all the waiting positions of the first, second, and third transport paths 401*a*, 401*b*, and 401*c*, printing of the sheet 5D does not start until the waiting time specified for the sheet 5A on the first transport path 401*a* has elapsed.

Figure 14:
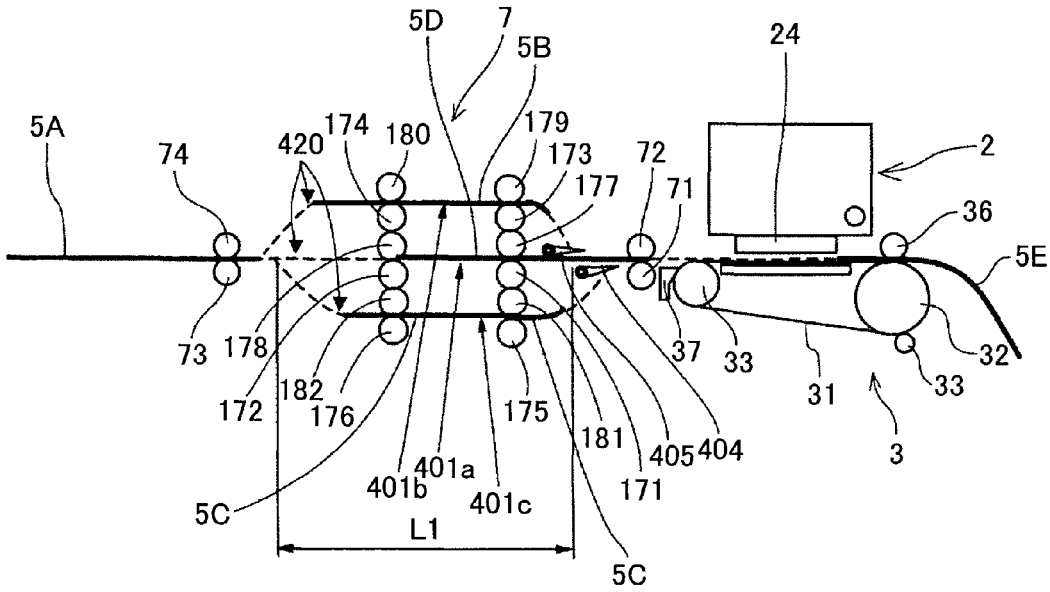
FIG. 14 is a schematic diagram illustrating the statuses of first through fifth sheets.

Then, as shown in FIG. 14, when the waiting time specified for the sheet 5A has elapsed, the sheet 5A on the first transport path 401*a* is transported to the discharge and transport path 70 or the duplexing path 90*c*. At the same time, the sheet 5D is printed while being transported toward the first transport path 401*a*. When printing is completed, the sheet 5D is transported to the waiting position of the first transport path 401*a*. The sheet 5E is transported to the printing start position with a predetermined distance (e.g., 60 mm) from the sheet 5D.

After that, the same operations as the operations described with reference to FIGS. 9-14 are repeatedly performed.

Referring back to FIG. 8, the various setting conditions used for selecting the waiting mode or the normal mode and specifying the waiting time are described below.

First, the first information piece about the degree of the curl of the sheet 5 is described.

For example, temperature and humidity are detected by reading detection signals from the temperature and humidity sensor 300 disposed at least at one of the positions S1-S3. If, for example, the temperature and the humidity are low and the type of the sheet 5 is plain paper, the sheet 5 is dry and therefore is easily curled. Accordingly, the number of conditions specifying the waiting mode is increased. If the waiting mode is selected, a relatively long waiting time is specified. It is to be noted that the relationship between the temperature and humidity and the waiting time is not limited to the one described in this example and may greatly vary depending on the type of the sheet 5.

Then, the information about the type of the sheet (recording medium) 5 is read from the control unit 200. The type of the sheet 5 may be entered by a user of the image forming apparatus using the operations panel 222 or using a printer driver of a host device, for example. Alternatively, the type of the sheet 5 may automatically be detected. If, for example, the sheet 5 is the type (e.g., thin paper) that is easily curled, the waiting mode is selected and a relatively long waiting time is specified. On the other hand, in the case where the sheet 5 is of the type that is hard and not easily curled, the number of conditions specifying the normal mode is increased.

Then, the printing mode (e.g., a high image quality printing mode that puts priority on the image quality over the printing speed, a high speed printing mode that puts priority on the printing speed over the image quality) is read. The printing mode may be entered by a user of the image forming apparatus using a printer driver of a host device, for example. Because, in the high image quality printing mode, the period of time during which the printed sheet 5 is held in the apparatus to be overwritten is relatively long (i.e., a substantial waiting time is applied), the number of conditions specifying the normal mode is increased. In the case where the waiting mode is selected when the high image quality printing mode is selected, a relatively short waiting time is specified. It is to be noted that the relationship between the printing mode and the waiting time is not limited to the one described in this example. For example, the waiting time may be specified based on the previously found influence of the printing mode on formation of the curl of the sheet 5.

Then, the sheet size is read. The sheet size may be entered by a user of the image forming apparatus using the operations panel 222 or using a printer driver of a host device, for example. The difference in the orientation of the sheets 5 (e.g., a landscape-oriented A4-size sheet 5 and a portrait-oriented A4-size sheet 5) is also regarded as a difference in the size. For example, if the length of the sheet 5 is greater than a transport path distance L1 of FIG. 9, the normal mode is selected. However, even if the size of the sheet 5 is greater than the transport path distance L1 of FIG. 9, it is possible to hold the sheet 5 in the waiting mode in the area across the first transport path 401*a* and the discharge and transport path 70 if necessary. In this case, the next recording operation is also held in a waiting mode.

Figure 15A:
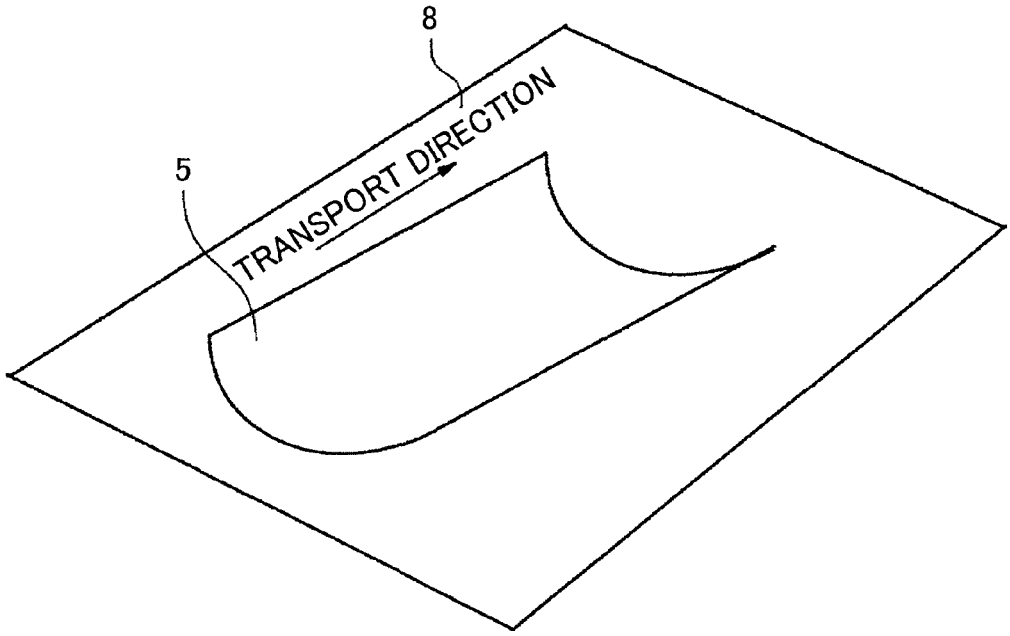
FIGS. 15A and 15B are schematic perspective views each illustrating a curled sheet.
Figure 15B:
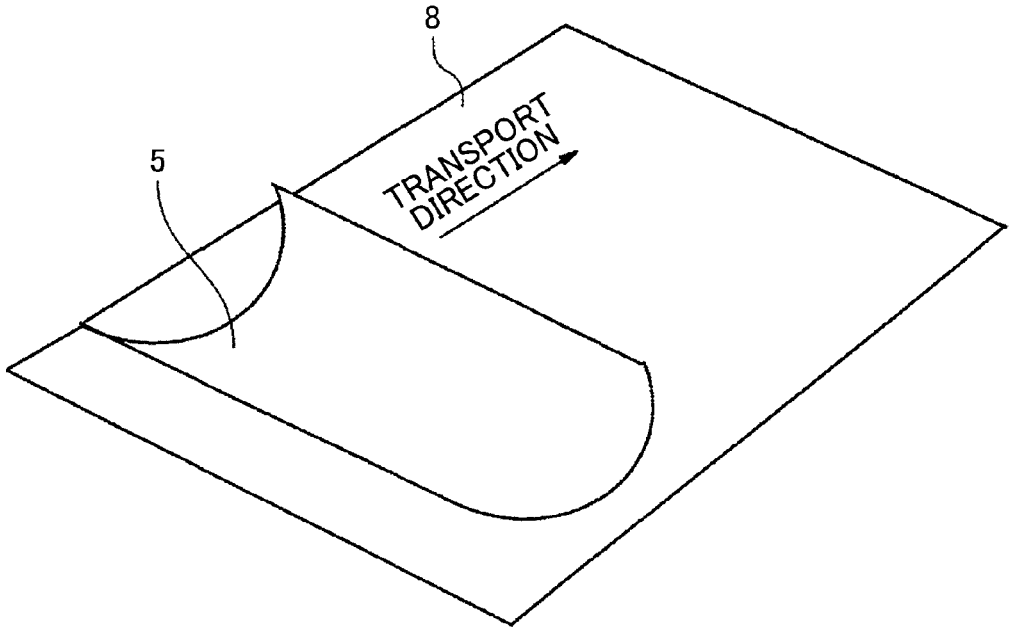

The relationship between the orientation of the sheet 5 and the direction of curl is described with reference to FIGS. 15A and 15B. FIGS. 15A and 15B are diagrams each illustrating a curled sheet 5 discharged in the discharge tray 8. More specifically, FIG. 15A illustrates a discharged portrait-oriented A4-size sheet 5 discharged, and FIG. 15B illustrates a discharged landscape-oriented A4-size sheet 5. As shown in FIG. 15A and FIG. 15B, the sheets 5 in the portrait orientation and the landscape orientation have a 90 degree difference in the direction in which curls are formed. Because the landscape-oriented sheet 5 is curled in the direction orthogonal to the transport direction, the landscape-oriented sheet 5 that is being discharged pushes out the previously discharged landscape-oriented sheet 5. Accordingly, it is difficult to stack the landscape-oriented sheets 5. Therefore, in the case where the sheet 5 is curled in the direction orthogonal to the transport direction as shown in FIG. 15*b*, the number of conditions specifying the waiting mode is increased. If the waiting mode is selected, a relatively long waiting time is specified.

The direction of the curl is not uniquely determined by the orientation (portrait or landscape) of the sheet 5 and is determined also by the fiber orientation of the sheet 5. Because the sheet 5 expands in the direction orthogonal to the fiber orientation, the sheet 5 may be curled in the direction orthogonal to the fiber orientation. Accordingly, the relationship between the portrait-oriented A4-size sheet 5 and the direction of the curl is not uniquely determined. The above example is presented because the A4-size sheets having the above-described relationship are widely available in the market place.

Then, the image data to be printed are read. For example, before or after performing a printing operation, image data transmitted from a host device or read by the image reading unit 11 may be read. In this step, either the waiting mode or the normal mode is selected depending on the print area size and the width of the print area distribution. The greater the print area size and the width of the print area distribution, the more easily the sheet 5 is curled, and the greater the number of conditions specifying the waiting mode. If the waiting mode is selected, a relatively long waiting time is specified. It is to be noted that the relationship between the print area size and width of the print area distribution and the waiting time is not limited to the one described in this example and the waiting time may greatly vary depending especially on the width of the print area distribution.

If the necessity of a waiting operation for decurling is determined based on the image data in this way, the necessity of a waiting operation can be determined at the stage before actually ejecting liquid droplets onto the sheet 5. In other words, the necessity of a waiting operation for decurling can be determined for each of the sheets 5 to be printed before printing each of the sheets 5.

Then, the amount (the ejected droplet amount) of the recording liquid ejected from the recording heads 24 during printing is read. In this image forming apparatus, the number of liquid droplets ejected from the recording heads 24 is counted in order to calculate the ink consumption. The ejected droplet amount is determined based on the count of the number of liquid droplets. Then, for example, when printing is completed, the necessity of a waiting operation may be determined based on the amount of liquid droplets ejected on the trailing portion of the sheet (recording medium) 5.

The trailing portion of the sheet 5 is discharged in a relatively short period of time from completion of printing. In the case where the trailing portion has a large print area (i.e., in the case where the trailing portion has a high printing rate, or in the case where a large amount of liquid droplets is ejected on the trailing portion), if the necessity of a waiting operation is determined based on the amount of liquid droplets ejected on the entire sheet 5 (the average number of droplets per sheet=printing rate), the degree of curl at the trailing portion of the sheet 5 is not correctly determined, which may result in a stacking failure.

If the necessity of a waiting operation and the length of the waiting time are determined based on the amount of liquid droplets ejected on the trailing portion of the sheet (recording medium) 5, it is possible to prevent a stacking failure. In this example, the necessity of a waiting operation and the length of the waiting time are determined based on the ejected liquid amount at the trailing portion. However, in the case where the printing area ends at the center portion, the necessity of a waiting operation and the length of the waiting time may be determined based on the ejected liquid amount at the center portion. Alternatively, the determination may be made based on the ejected liquid amount at an end portion of the sheet 5 which easily affects curling. For example, when printing is completed, the necessity of a waiting operation may be determined based on the amount of liquid droplets ejected on the entire sheet (recording medium) 5 and the amount of the liquid droplets ejected on the trailing portion of the sheet 5.

The average number of droplets AVE1 per unit area of the entire sheet 5 is calculated based on the amount of liquid droplets on the entire sheet 5, and the average number of droplets AVE2 per unit area of the trailing portion (e.g., the area from the trailing edge to 50 mm inside) of the sheet 5 is calculated based on the amount of liquid droplets on the trailing portion. The greater one of the average number of droplets AVE1 and the average number of droplets AVE2 is regarded as the printing rate of the sheet 5, based on which the necessity of a waiting operation is determined.

In this way, the necessity of a waiting operation can be more accurately determined than in the case where the determination of the necessity is made based on only either one of the number of droplets on the entire sheet 5 and the number of droplets on the trailing portion of the sheet 5.

Although the amount of the ejected recording liquid (the ejected liquid droplet amount) is counted and read in this example, the image data may be used for computing the ejected recording liquid amount. More specifically, similar operations are performed based on the ejected recording liquid amount computed from the image data, thereby determining the necessity of a waiting operation for decurling based on the ejected recording liquid amount. In this case, the necessity of a waiting operation for decurling can be determined for each of the sheets 5 to be printed before printing each of the sheets 5.

Then, information about the discharge destination of the sheet 5 is read. If, for example, the straight discharge tray 409 is selected as the discharge destination, the sheet 5 is discharged with the printed side up. In this case, the direction of the curl is vertically inverted with respected to those shown in FIGS. 15A and 15B. In other words, the sheet 5 is curled with two longer sides down. Therefore, the sheet 5 is decurled due to its own weight, and the sheets 5 discharged on the straight discharge tray 409 are more easily stacked on one another than the sheets 5 discharged on the discharge tray 8. That is, for example, in the case where a tray onto which the sheet 5 is discharged with the printed side up is selected as the discharge destination, the number of conditions specifying the waiting mode is reduced. If the waiting mode is selected, a relatively short waiting time is specified.

Next, control for selection of the waiting mode or setting of the waiting time for a target sheet 5 based on the information (second information piece) about subsequent sheets 5 to be printed following the printed sheet (target sheet) 5 is described with reference also to FIGS. 16A-18B.

The selection of the waiting mode and setting of the waiting mode are performed for the target sheet 5 based on the information piece about curls of the subsequent sheets 5 and the information piece about the number of the subsequent sheets 5.

The information about the subsequent sheets 5 (the temperature and humidity, the type of the sheet, the printing mode, the sheet size, image data, image data, the amount of liquid droplets ejected on the entire sheet or the trailing portion as a predetermined area of the sheet, and the discharge destination of the sheet) is read.

If a waiting operation for decurling the sheet 5 to be printed next is determined not to be necessary or if the waiting time is determined to be relatively short based on at least one of the above-described various information pieces, the conditions specifying the waiting mode are reduced. If the waiting mode is selected, a relatively short waiting time is specified.

Figure 16A:
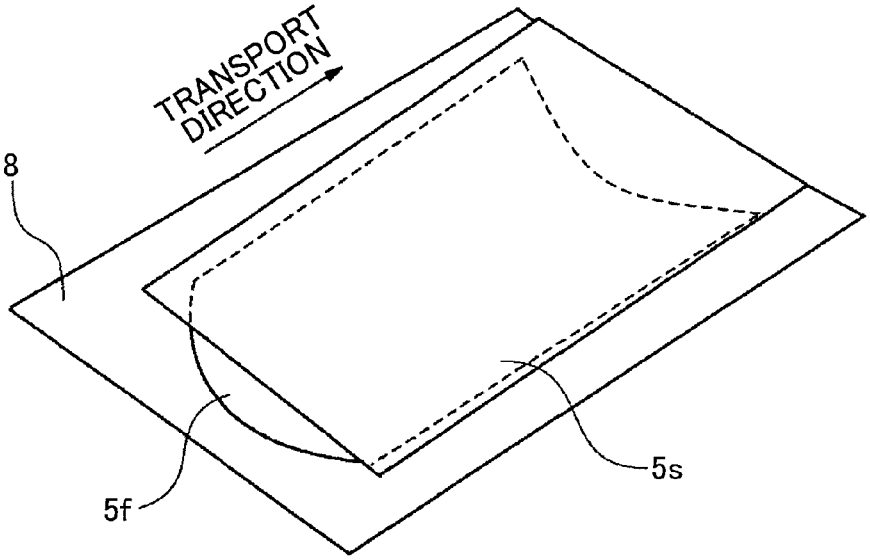
FIGS. 16A and 16B are schematic perspective views each illustrating first and second sheets sequentially discharged in a discharge tray.
Figure 16B:
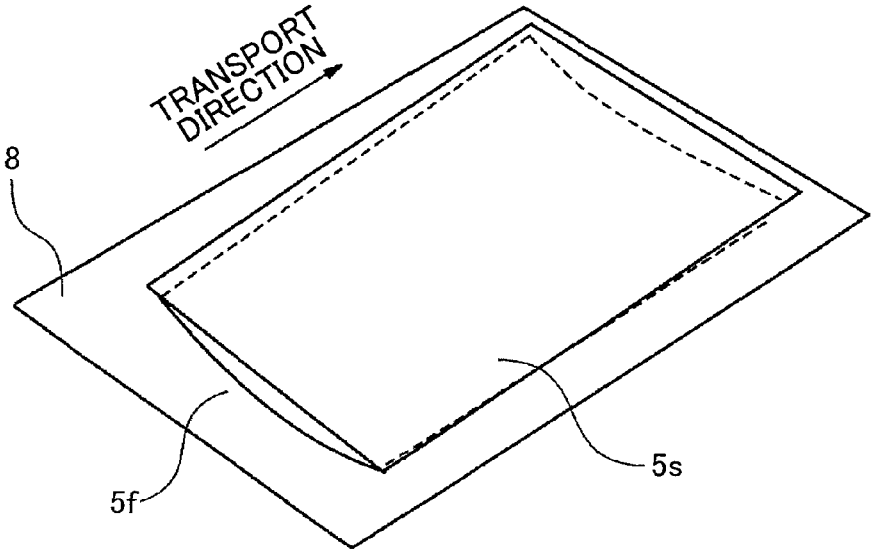
Figure 17A:
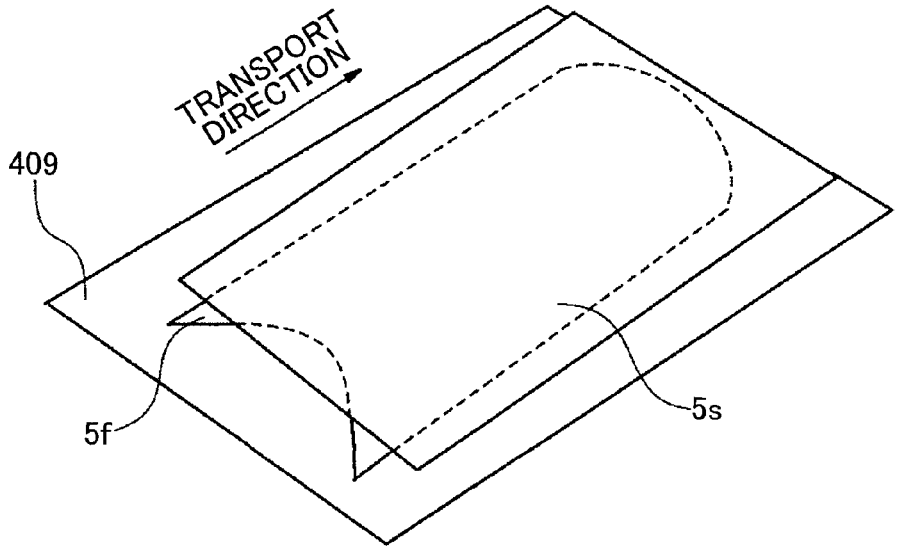
FIGS. 17A and 17B are schematic perspective views each illustrating first and second sheets sequentially discharged in a discharge tray.
Figure 17B:
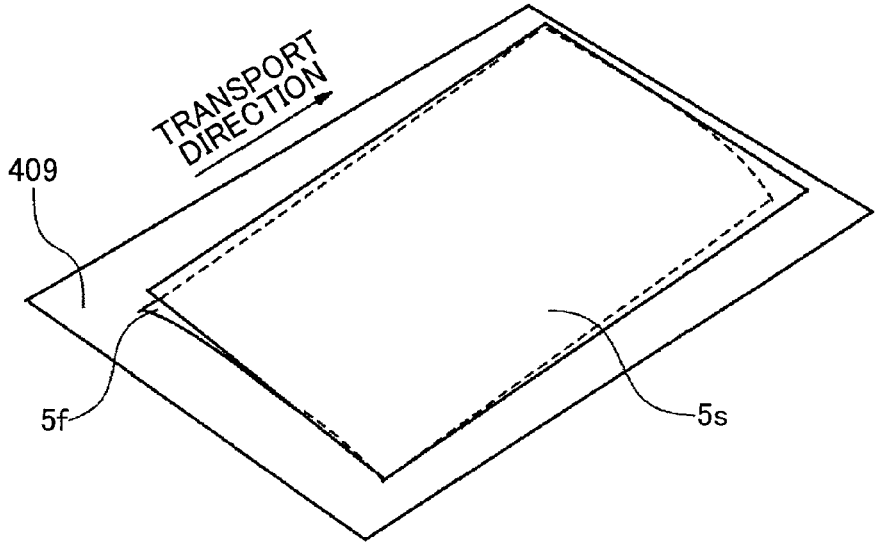

A detailed description about this point is given below with reference to FIGS. 16A-17B. FIGS. 16A-17B are schematic diagrams each illustrating a curled sheet 5*f* and a flat sheet 5*s* discharge on the curled sheet 5*f*. The portion of the lower curled sheet 5*f* hidden by the upper sheet 5*s* is shown by the dotted line. FIGS. 16A and 16B schematically illustrate the sheets 5*f* and 5*s* discharged on the discharge tray 8. FIGS. 17A and 17B schematically illustrate the sheets 5*f* and 5*s* discharged on the straight discharge tray 409.

If the sheet 5*s* is discharged on the previously discharged sheet 5*f* as shown in FIGS. 16A and 17A, the degree of curl of the previously discharged sheet 5*f* is reduced over time as shown in FIGS. 16B and 17B. That is, if a waiting operation for decurling the sheet 5*s* to be printed next is determined not to be necessary, the flat sheet 5*s* is stacked on the curled sheet 5*f* as shown in FIGS. 16A and 17A. Thus, the sheet 5*f* is decurled on the discharge tray 8 or 409 due to the weight of the sheet 5*s*. This effect can reduce the number of conditions specifying the waiting mode for the target sheet 5 (5*f*). If the waiting mode is selected, a relatively short waiting time can be specified.

Figure 18A:
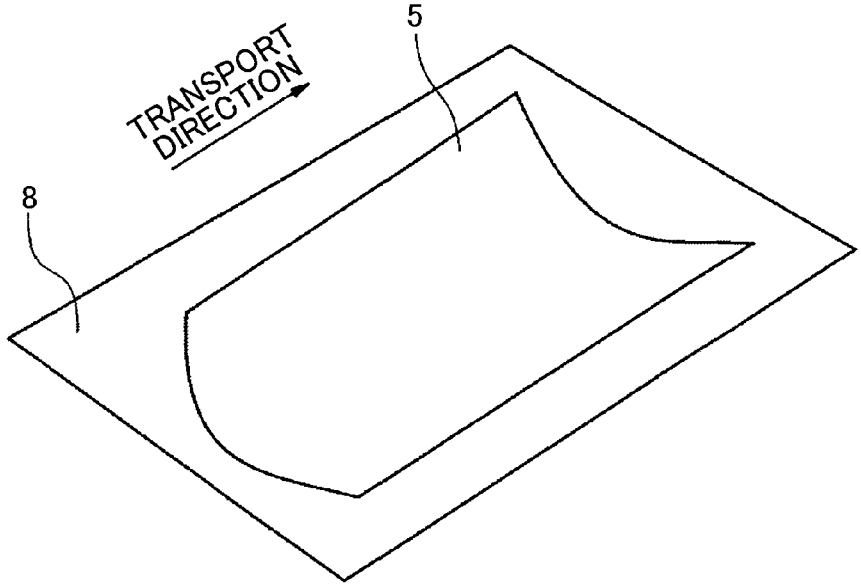
FIGS. 18A and 18B are perspective view illustrating an advantageous effect of decurling.
Figure 18B:
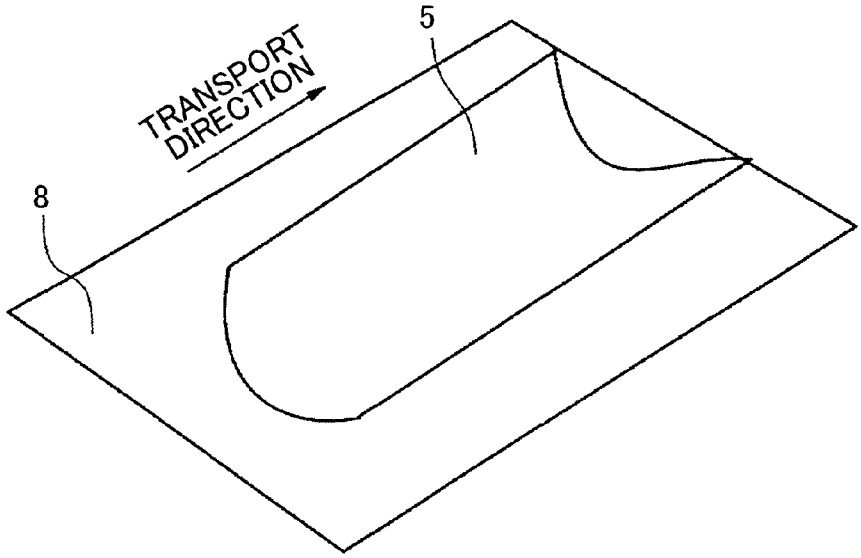

Advantageous effects of decurling are described below with reference also to FIGS. 18A and 18B. The curl of the sheet 5 of FIG. 18A discharged on the discharge tray 8 progresses even on the discharge tray 8, so that the sheet 5 is further curled as shown in FIG. 18B. Especially, if the sheet 5 is printed at relatively high speed and discharged, because the sheet 5 is discharged before completely expanding due to moisture, the rate of the progress of the curl on the discharge tray 8 is increased. That is, if a flat subsequent sheet 5 is discharged before the curl of the previously discharged sheet 5 progresses, the progress of curl of the previously discharged sheet 5 stops due to the weight of the subsequent sheet 5 stacked thereon while the degree of curl is relatively small. Furthermore, the previously discharged sheet 5 is decurled due to the weight of the stacked subsequent sheet 5.

That is, discharging a non-curled sheet 5 at a relatively early timing on a sheet 5 that may otherwise be curled can prevent the curling. If a waiting operation for decurling is determined not to be necessary or if the waiting time is determined to be relatively short based on this effect, the number of conditions specifying the waiting mode can be reduced. If the waiting mode is selected, a relatively short waiting time can be specified.

Operations to be performed when a waiting operation for decurling is determined not to be necessary or when the waiting time is determined to be relatively short are not limited to the operations described in this embodiment. For example, the weight of a single sheet stacked on the previously discharged sheet may not be sufficient to decurl the previously discharged sheet depending on the degree of curl of the previously discharged sheet. In that case, if plural sheets are to be stacked on the curled sheet, not performing a waiting operation can be specified.

The conditions under which the sheet discharged on the discharge tray is decurled by the sheet(s) (subsequent sheet (s)) stacked on top may be calculated in advance, and information indicating the relationship between the various setting conditions and the waiting time may be stored in a table format in the nonvolatile memory (NVRAM) 204 or the like in advance. In the case where the sheet is determined to be decurled by the subsequent sheet(s) with reference to this table, the number of conditions specifying the waiting mode can be reduced. If the waiting mode is selected, a relatively short waiting time can be specified.

In the above description, the sheet decurling conditions are described. For example, in view of stackability, conditions under which a sheet to be discharged onto the discharge tray can be provided with flatness at the top of the discharge tray due to the sheets stacked on the discharge tray, which stacked sheets do not block the sheet to be discharged next may be calculated in advance. In the case where discharge stackability is determined to be obtained due to the subsequent sheet, the conditions specifying the waiting mode can be reduced. If the waiting mode is selected, a relatively short waiting time can be specified.

In this case, for example, if decurling of the sheet to be discharged last (the sheet not followed by a sheet to be discharged within a predetermined time period) is determined not to be necessary, or in the case where the waiting time is determined to be relatively short, because the last sheet with a relatively small amount of curl can be discharged before the degree of curl of the previously discharged sheet is increased, sufficient stackability is determined to be obtained and a waiting operation may not be performed for any of the sheets.

Even if decurling of the sheet to be discharged last (the sheet not followed by a sheet to be discharged within a predetermined time period) is determined to be necessary, decurling may be performed only on the last sheet. In this case, although decurling takes time, the sheet can be decurled. Also, it is possible to prevent the degree of curl from becoming greater than a certain amount. The progress of curl of the discharged sheet at the top is not inhibited, and the degree of the curl cannot be controlled, so that the sheet may become curled up.

The last sheet of a job is not necessarily the sheet to be discharged last (the sheet not followed by a sheet to be discharged within a predetermined time period). In the case where the last sheet of a job is followed by a sheet of another job to be discharged within a predetermined time period, the last sheet of the job may be determined not to be the sheet to be discharged last.

The following describes the case where sheets of different jobs are discharged. If a sheet that is to be subsequently discharged is of another job, the necessity of decurling is determined based on the type of the sheet. For example, if the subsequent sheet is a thin sheet and the current sheet is relatively greatly curled, because the subsequent sheet is not hard, a stacking failure may occur. Therefore, in the case where the subsequent sheet is not relatively hard such as a thin sheet, the number of conditions specifying the waiting mode is increased. If the waiting mode is selected, a relatively long waiting time is specified. On the other hand, in the case where the subsequent sheet is relatively hard, the number of conditions specifying the waiting mode can be reduced. If the waiting mode is selected, a relatively short waiting time can be specified.

In this way, based on various predetermined conditions, the waiting time for decurling is specified so that the sheet is decurled on the discharge tray instead of decurling the sheets individually one by one. That is, because the decurling time varies depending on the above-described various predetermined conditions, the waiting time is specified based on these conditions, thereby preventing a reduction in the productivity due to a waiting operation.

As mentioned above, waiting time and a condition, which includes a combination of at least two information pieces of the information pieces about the temperature and humidity, the ejected droplet amount, the type of the sheet, the printing mode, the sheet size, image data, the amount of recording liquid, the discharge destination, and the waiting operations for the subsequent sheets, are stored in a table formed in the nonvolatile memory (NVRAM) 204 or the like in advance. The necessity of a waiting operation and the length of the waiting time can be determined by referring to this table.

Next, a method of determining the necessity of a waiting operation and the length of the waiting time based on an external device signal or an operations panel signal is described. The necessity of a waiting operation and the length of the waiting time may be specified by a user of the image forming apparatus using the operations panel 222 or using a printer driver of a host device.

For example, if the user wants to print a small number of sheets with his/her priority on quickness in discharging the printed sheets over discharge stackability, the user may select the normal mode (non-waiting mode). Or, for example, a mode (e.g., a speed preference mode) of short waiting time may be provided so that the user may select this mode. Further, if the user wants to print sheets that are not easily curled, the user may select the normal mode (non-waiting mode). Or, for example, a mode (e.g., a speed preference mode) of short waiting time may be provided so that the user may select this mode. Various conditions may be specified by individual users and be stored in the nonvolatile memory 204. Thus, each user reads his/her own various conditions upon performing printing and the necessity of a waiting operation and the length of the waiting time may be specified based on the his/her own various conditions.

The provision of a unit that switches the waiting mode and the normal mode allows transport without delay control, thereby preventing a reduction in productivity due to delay time. Further, under the condition under which the waiting mode cannot be specified, the waiting mode is not used to prevent sheets from being jammed or folded.

If switching of the mode is based on the above-described various predetermined conditions, the decurling time varies depending on the predetermined conditions. Therefore, the decurling time may be estimated based on the predetermined conditions, so that transport without switching to the waiting mode can be performed under the condition that a waiting operation is not required, thereby preventing a reduction in productivity due to delay time.

According to the image forming apparatus having the above-described transport device, it is possible to form images on various types of sheets using a non-contact image formation process, and therefore it is possible to improve the image quality due to high accuracy droplet ejection, and formation of small dots; balance the drying performance and the productivity; reduce energy use; and reduce the cost.

Next, a transport device according to a second embodiment of the present invention is described below with reference to FIG. 19.

The first transport path 401*a* of the plural transport paths 401 (the first, second, third transport paths 401*a*, 401*b*, and 401*c*) of the second embodiment is disposed on top of the other transport paths 401*b* and 401*c*. With this configuration, removal of a jammed sheet from the first transport path 401*a*, which is frequently used, is facilitated.

Further, plural transport paths 70 as waiting and transport paths, namely, first, second, third discharge and transport paths 70 (70*a*, 70*b*, and 70*c*) are provided in a discharge unit 412.

Figure 19:
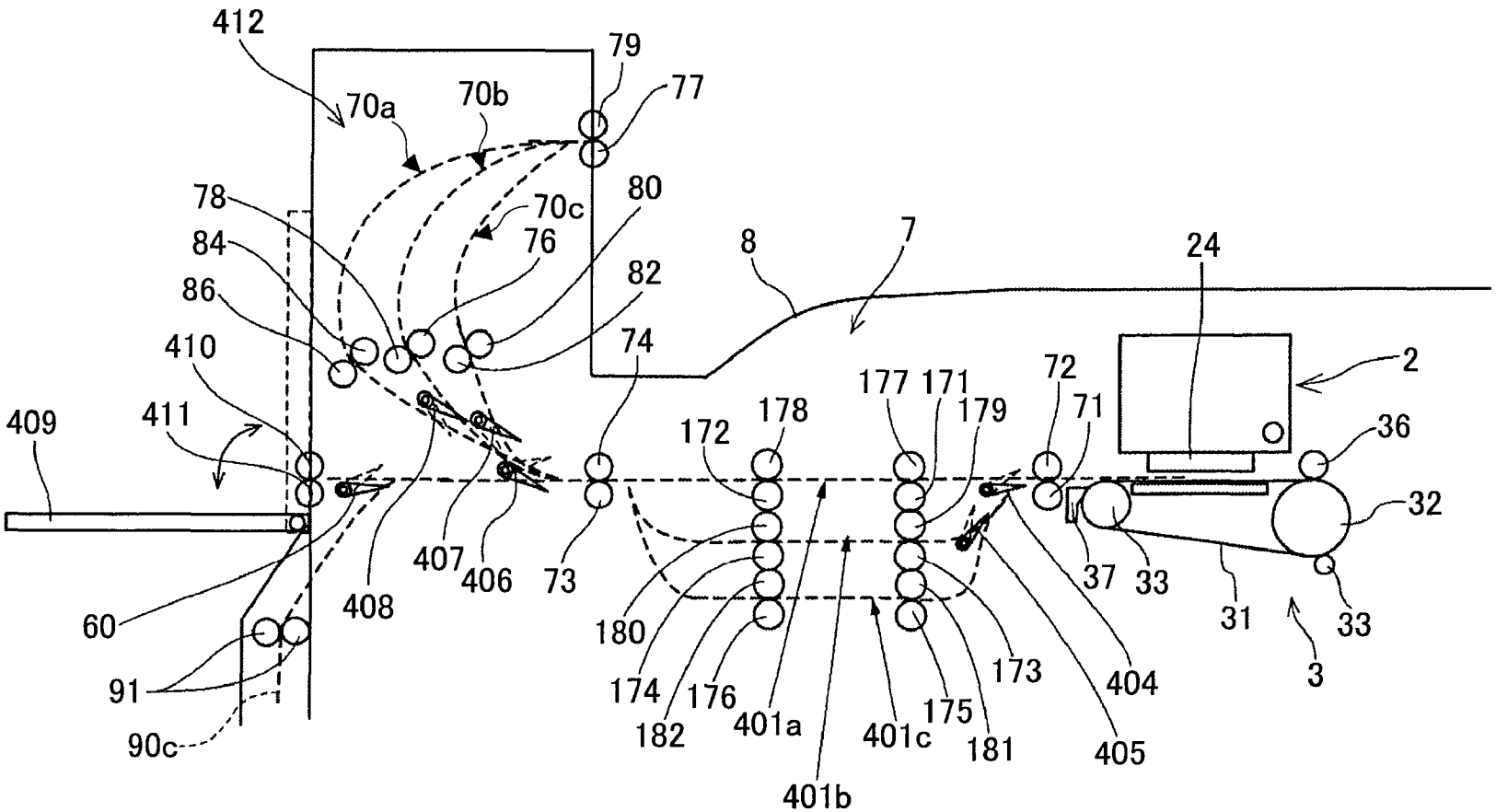
FIG. 19 is a schematic diagram schematically illustrating a transport device according to a second embodiment of the present invention.

As shown in FIG. 19, the discharge unit 412 includes the pair of transport rollers 73, 74 (the discharge roller 74 may preferably be a spur) for transporting the sheet 5 to the discharge and transport paths 70, the duplexing unit 10, or the straight discharge tray 409; a switching plate 406 that is configured to switch the transport direction of the sheet 5 between the direction of the discharge and transport paths 70 and the direction of the duplexing unit 10 (the vertical duplexing path 90*c*)/the straight discharge tray 409 and is rotatable between the position shown by the solid line and the position shown by the dotted line; a switching plate 60 that is configured to switch the transport direction between the duplexing unit 10 (the vertical duplexing path 90*c*) and the straight discharge tray 409 and is rotatable between the position shown by the solid line and the position shown by the dotted line; a switching plate 407 that is configured to switch the transport direction of the sheet 5 between the first discharge and transport path 70*a*/the second discharge and transport path 70*b* and the third discharge and transport path 70*c* and is rotatable between the position shown by the solid line and the position shown by the dotted line; a switching plate 408 that is configured to switch the transport direction of the sheet 5 between the first discharge and transport path 70*a* and the second discharge and transport path 70*b* and is rotatable between the position shown by the solid line and the position shown by the dotted line; transport rollers 86, 78, and 82, respectively on the first, second, and third discharge and transport paths 70*a*, 70*b*, and 70*c*; spurs 84, 76, and 80 facing the transport rollers 86, 78, and 82, respectively; a pair of discharge rollers 77, 79 (the discharge roller 77 may preferably be a spur) for discharging the sheet 5 onto the discharge tray 8; and a pair of straight discharge rollers 410, 411 for transporting the sheet 5 to the straight discharge tray 409. The rollers 84, 76, and 80 and the corresponding spurs 84, 76, and 80 nip the sheets 5 from the lower and upper sides, respectively.

The switching plate 407 is rotatable between the position for the direction of the first and second discharge and transport paths 70*a* and 70*b* shown by the solid line and the position for the third discharge and transport path 70*c* shown by the dotted line to switch the transport direction of the sheet 5 between the direction of the first and second discharge and transport paths 70*a* and 70*b* and the direction of the third discharge and transport path 70*c*. When in the position shown by the solid line, the switching plate 407 guides the sheet 5 to the first discharge and transport path 70*a* on which the transport roller 86 and the spur 84 are disposed/the second discharge and transport path 70*b* on which the transport roller 78 and the spur 76 are disposed, respectively. When in the position shown by the dotted line, the switching plate 407 guides the sheet 5 to the third discharge and transport path 70*c* on which the transport roller 82 and the spur 80 are disposed.

The switching plate 408 is rotatable between the position for the direction of the first discharge and transport path 70*a* shown by the solid line and the position for the second discharge and transport path 70*b* shown by the dotted line to switch the transport direction of the sheet 5 between the direction of the first discharge and transport path 70*a* and the direction of the second discharge and transport path 70*b*. When in the position shown by the solid line, the switching plate 408 guides the sheet 5 to the first discharge and transport path 70*a* on which the transport roller 86 and the spur 84 are disposed. When in the position shown by the dotted line, the switching plate 408 guides the sheet 5 to the second discharge and transport path 70*b* on which the transport roller 78 and the spur 76 are disposed.

As shown in FIG. 19, each of the plural discharge and transport paths 70, namely the first, second, third discharge (waiting) and transport paths 70*a*, 70*b*, and 70*c* are arcuate paths bent in an arch in the direction opposite to the direction of the curl of the landscape-oriented A4-size sheet 5 of FIG. 15B. That is, these waiting and transport paths 70 also serve as a decurler. Causing the sheets 5 to wait in these waiting and transport paths 70 can further reduce the waiting time, thereby improving the productivity. The layout of the discharge and transport paths 70 and the number of the rollers and spurs are not limited to those described in the above embodiment. The number of the rollers and spurs may be increased or reduced. The positive effect of the decurler is not limited to the landscape-oriented A4-size sheet 5. For example, the decurler (the waiting and transport paths 70) can cause a portrait-oriented A4-size sheet 5 to be held while decurling the sheet 5 by bending the sheet 5 in an arc in the direction orthogonal to the direction of the curl. This can reduce the waiting time, thereby improving the productivity. The waiting operations of the sheets 5 on the first, second, and third discharge and transport paths 70*a*, 70*b*, and 70*c* are performed in the same manner as in the first embodiment and are not described herein.

In this embodiment, because plural paths are formed by dividing an arcuate portion of a path, it is possible to reduce the size of the apparatus. Furthermore, because the sheet is held stationary while being bent, the decurling effect is increased, thereby reducing the decurling time.

Figure 20:
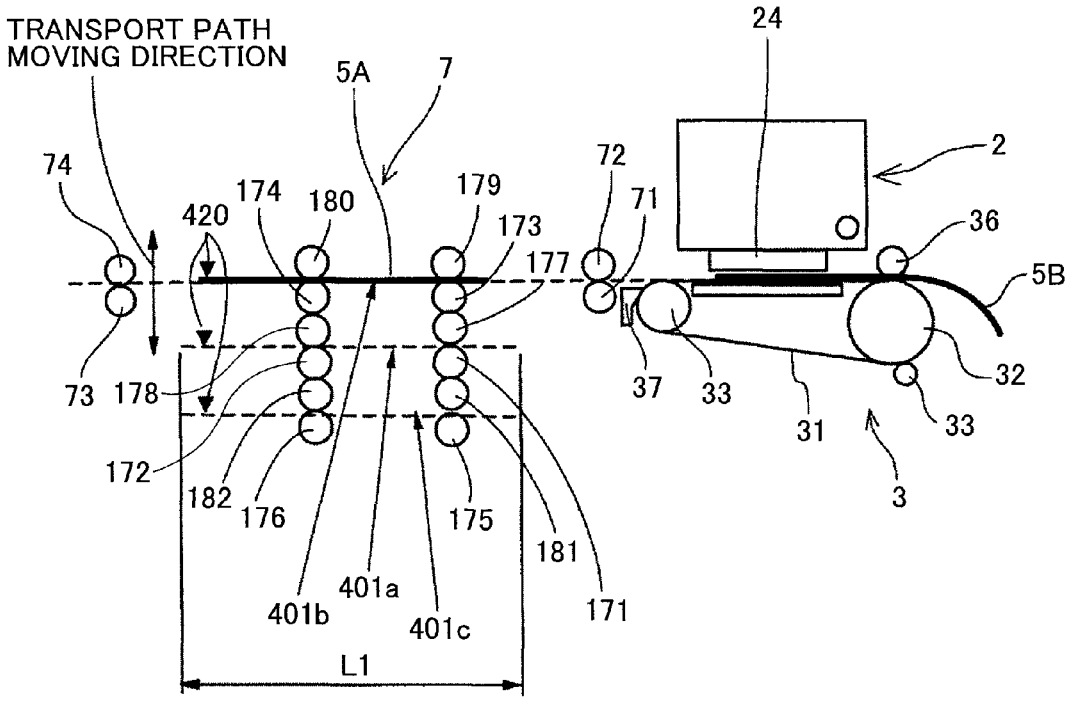
FIG. 20 is a diagram schematically illustrating a transport device according to a third embodiment of the present invention.
Figure 21:
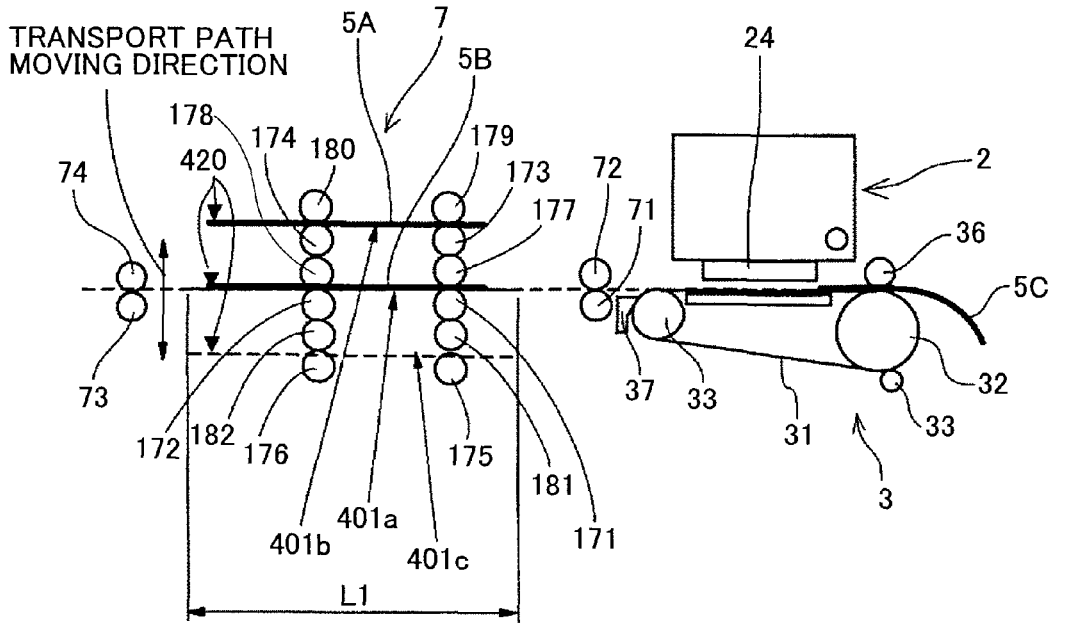
FIG. 21 is a schematic diagram for illustrating an operation according to the third embodiment.

Next, a transport device according to a third embodiment of the present invention is described below with reference to FIGS. 20 and 21.

In this embodiment, a drive source (not shown) is used for switching between the first, second, and third transport paths 401*a*, 401*b*, and 401*c* in place of switching plates. The drive source switches between the first, second, and third transport paths 401*a*, 401*b*, and 401*c* by vertically moving them. Therefore, the first, second, and third transport paths 401*a*, 401*b*, and 401*c* are straight transport paths, and can hold relatively hard or inflexible sheets 5 (e.g., plastic materials such as CD, cardboard, and glossy paper) in the waiting mode. That is, because the transport paths 401*a*, 401*b*, and 401*c* are substantially straight, it is possible to transport relatively hard sheets 5 (e.g., hard sheets such as cardboard and plastic materials). The waiting operations of the sheets 5 on the first, second, and third discharge and transport paths 401*a*, 401*b*, and 401*c* are performed in the same manner as in the first embodiment and are not described here.

Figure 22:
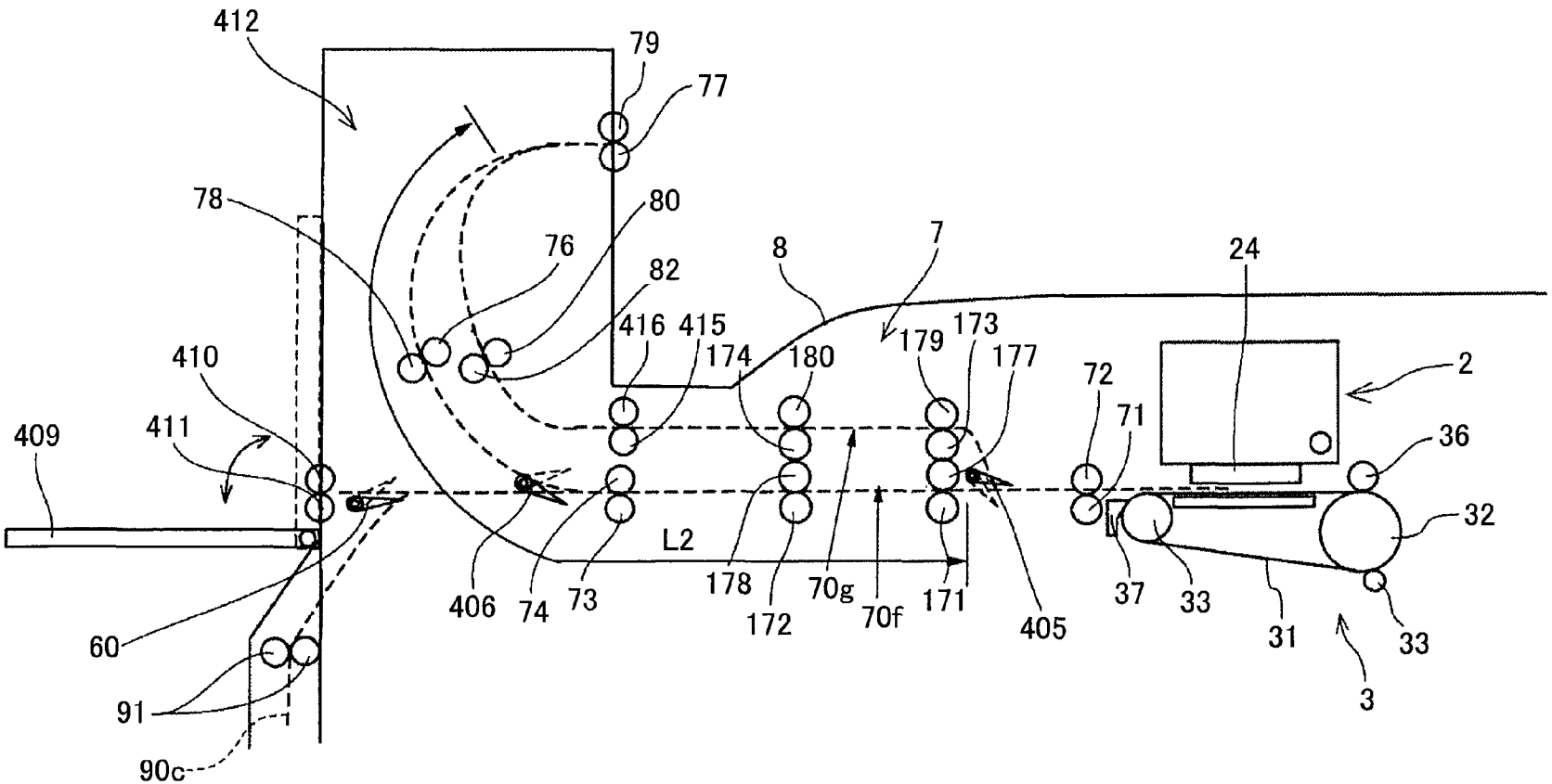
FIG. 22 is a diagram schematically illustrating a transport device according to a fourth embodiment of the present invention.

Next, a transport device according to a fourth embodiment of the present invention is described below with reference to FIG. 22.

In this embodiment, first and second transport paths 70*f* and 70*g* are provided as waiting and transport paths. The first transport path 70*f* and the second transport path 70*g* correspond to a path formed by connecting the first transport path 401*a* and the first discharge and transport path 70*a* and a path formed by connecting the second transport path 401*b* and the second discharge and transport path 70*b* to increase a transport path distance L2 (i.e., to increase the allowable sheet length L2 in the waiting operation). According to this configuration, the waiting mode can be selected for a relatively large-size sheet.

For example, each of the first and second transport paths 70*f* and 70*g* has a length sufficient to accommodate two sheets 5. That is, when $L2 \geqq L1 \times 2$ is satisfied, where L2 represents the transport path distance and L1 represents the length of the sheet 5, a total of four sheets 5 can be held stationary on the first and second transport paths 70*f* and 70*g*. In this case, the four sheets 5, which are the sheets 5A, 5B, 5C, and 5D transported in this order, are transported and held in the waiting mode in the following manner. For example, the sheets 5A and 5B may be transported to the first transport path 70*f* and are held in the waiting mode, and then the sheets 5C and 5D may be transported to the second transport path 70*g*. Alternatively, the sheets 5 are alternately transported to the first transport path 70*f* and the second transport path 70*g* and are held there. A method of transporting the sheet 5 and holding the sheet 5 in the waiting mode is not limited to this method and other various suitable methods may be used.

Figure 23:
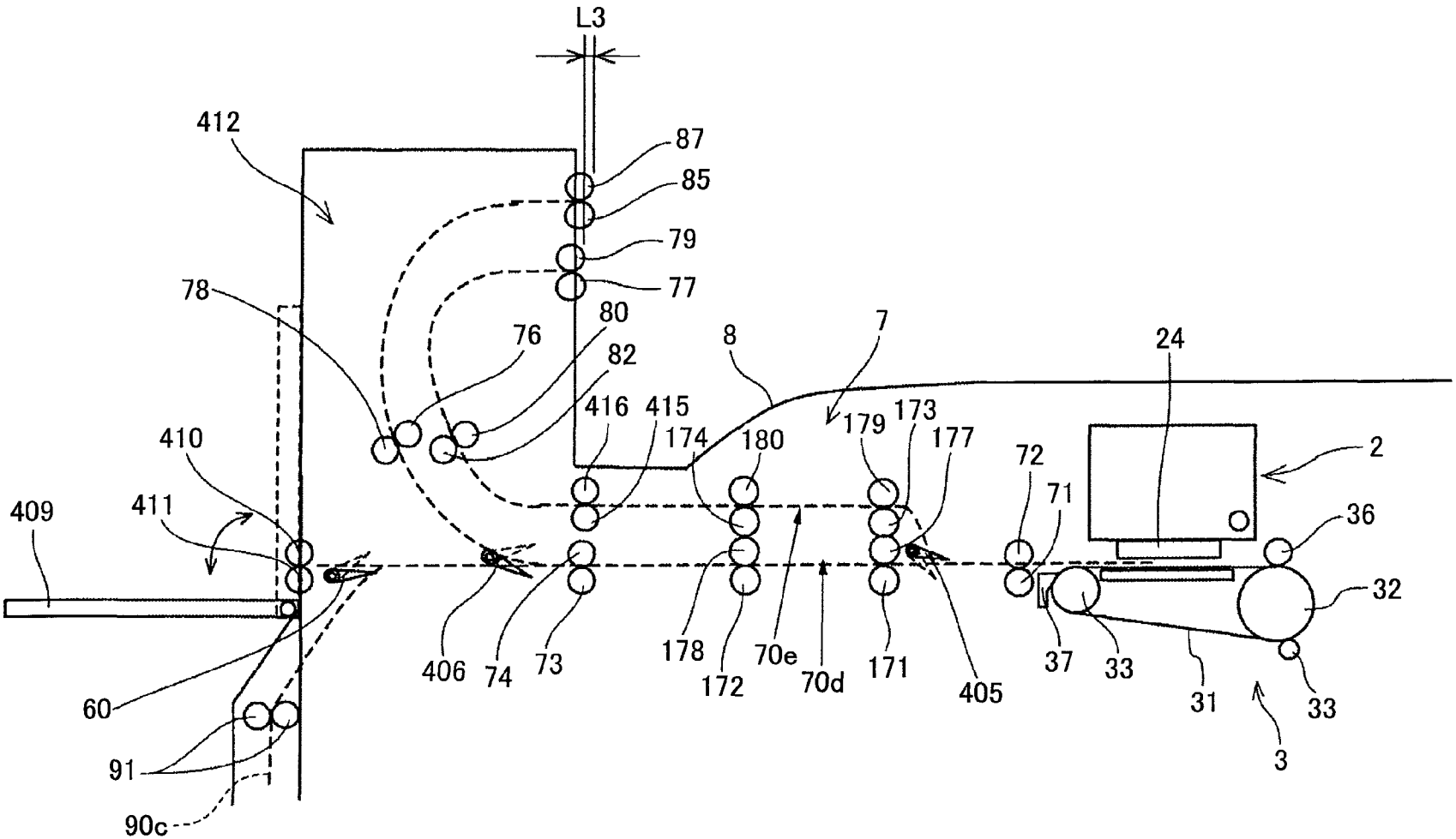
FIG. 23 is a diagram schematically illustrating a transport device according to a fifth embodiment of the present invention.

Next, a transport device according to a fifth embodiment of the present invention is described below with reference to FIG. 23.

In this embodiment, the lengths of first and second waiting and transport paths 70*d* and 70*e* are greater than the first and second waiting and transport paths 70*f* and 79*g* of the fourth embodiment. A pair of discharge rollers 85, 87 and a pair of discharge rollers 77, 79 are disposed at the downstream of the first and second waiting and transport paths 70*d* and 79*e*, respectively, in the discharge direction. According to this configuration, it is possible to further increase the allowable sheet length in the waiting operation. This configuration also allows the sheet 5 to be held in the waiting mode after the sheet 5 is transported beyond the pair of discharge rollers 77, 79 or the pair of discharge rollers 85, 87. That is, there is no upper limit on the allowable sheet length in the waiting operation. The pair of discharge rollers 85, 87 is disposed downstream the pair of discharge rollers 77, 79 by a distance L3 in the discharge direction to not interfere with the discharge of the sheet 5 by the pair of discharge rollers 77, 79. Waiting operations in this embodiment are performed in the same manner as in the above-described embodiments and are not described here.

Figure 24:
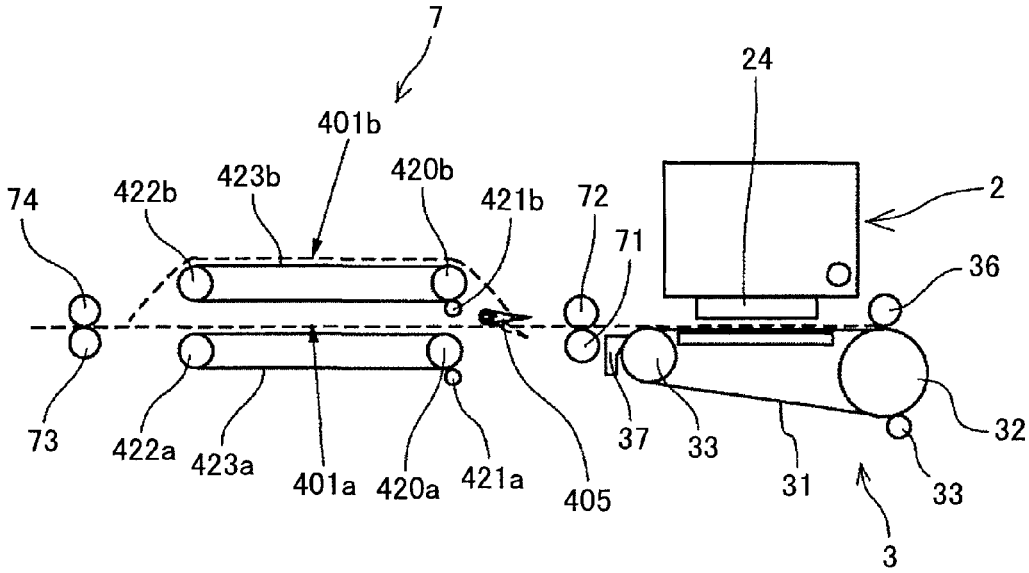
FIG. 24 is a diagram schematically illustrating a transport device according to a sixth embodiment of the present invention.

Next, a transport device according to a sixth embodiment of the present invention is described below with reference to FIG. 24.

In this embodiment, a first electrostatic attraction belt 423*a* forming the first transport path 401*a* and a second electrostatic attraction belt 423*b* forming the second transport path 401*b* are provided in the transport unit 7. The first and second electrostatic attraction belts 423*a* and 423*b* extend around transport rollers 422*a* and 422*b* and driven rollers 420*a* and 420*b*, respectively. The driven rollers 420*a* and 420*b* exert tension on the first and second electrostatic attraction belt 423*a* and 423*b*, respectively. Charging rollers 421*a* and 421*b* are provided as chargers that charge the surfaces of the first and second electrostatic attraction belts 423*a* and 423*b*, respectively, with a high voltage (alternating current) applied from a high-voltage power supply (AC bias supply unit). Each of the first and second electrostatic attraction belts 423*a* and 423*b* can electrostatically attract the sheet 5 to transport the sheet 5 and hold the sheet 5 in the waiting mode.

According to this configuration, because the sheet 5 is maintained flat while being held in the waiting mode, the sheet 5 is decurled or dried with a short waiting time, thereby preventing a reduction in the productivity due to a waiting operation. Furthermore, because there is no spur that comes in contact with the sheet 5, it is possible to prevent contamination of the sheet 5 even if the sheet 5 being transported is not dry. Waiting operations in this embodiment are performed in the same manner as in the above-described embodiments and are not described here.

Figure 25:
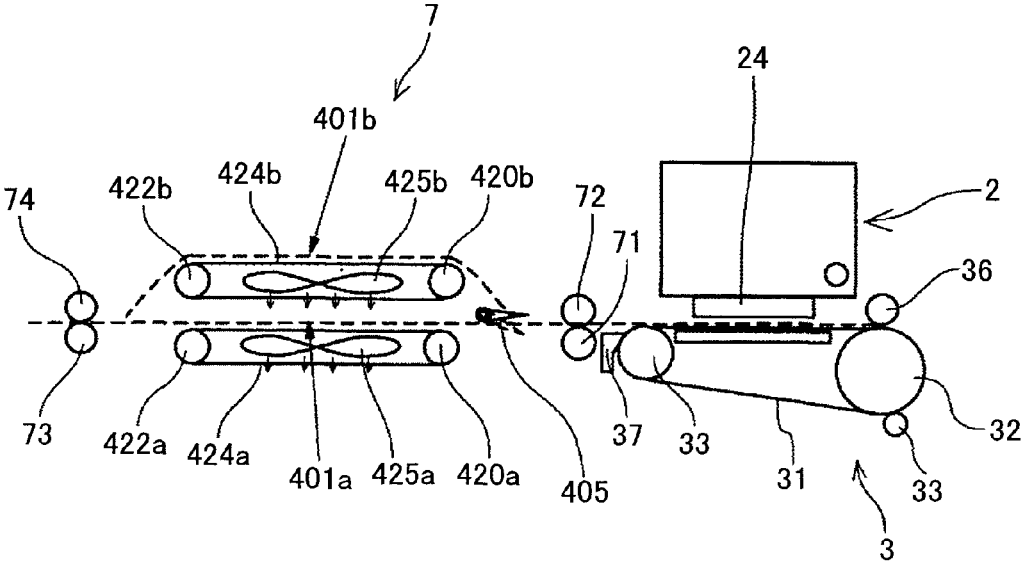
FIG. 25 is a diagram schematically illustrating a transport device according to a seventh embodiment of the present invention.

Next, a transport device according to a seventh embodiment of the present invention is described below with reference to FIG. 25.

In this embodiment, a first transport belt 424*a* having an air suction port and forming the first transport path 401*a* and a second transport belt 424*b* having an air suction port and forming the second transport path 401*b* are provided in the transport unit 7. The first and second transport belts 424*a* and 424*b* extend around transport rollers 422*a* and 422*b* and driven rollers 420*a* and 420*b*, respectively. The driven rollers 420*a* and 420*b* exert tension on the first and second electrostatic attraction belt 423*a* and 423*b*, respectively. Suction fans 425*a* and 425*b* for attracting the sheet 5 by air suction are provided at the inner sides of the first and second transport belts 424*a* and 424*b*, respectively. Thus, each of the first and second transport paths 401*a* and 401*b* can attract the sheet 5 by air suction to transport the sheet 5 and hold the sheet 5 in the waiting mode.

According to this configuration, because the sheet 5 is maintained flat while in the waiting mode, the sheet 5 is decurled or dried with a short waiting time, thereby preventing a reduction in the productivity due to a waiting operation. Furthermore, because there is no spur that comes in contact with the sheet 5, it is possible to prevent contamination of the sheet 5 even if the sheet 5 being transported is not dry. Waiting operations in this embodiment are performed in the same manner as in the above-described embodiments and are not described here.

Figure 26:
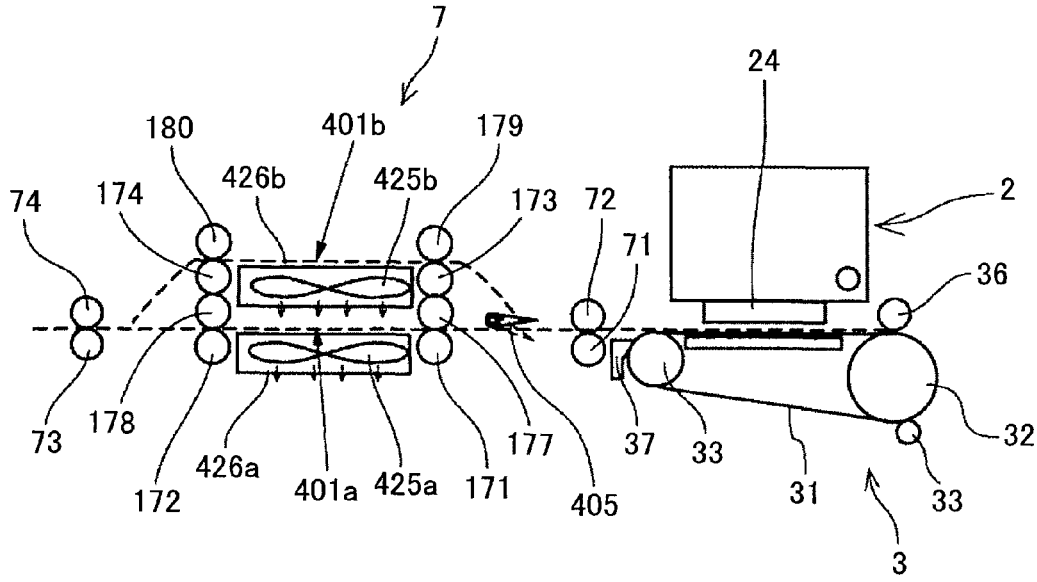
FIG. 26 is a diagram schematically illustrating a transport device according to an eighth embodiment of the present invention.

Next, a transport device according to an eighth embodiment of the present invention is described below with reference to FIG. 26. In this embodiment, a first transport guide 426*a* having an air suction port and forming the first transport path 401*a* and a second transport guide 426*b* having an air suction port and forming the second transport path 401*b*; suction fans 425*a* and 425*b* for attracting the sheets 5 by air suction to the first and second transport guides 426*a* and 426*b*, respectively; transport rollers 171, 172 and transport rollers 173, 174 for transporting the sheets 5; and spurs 177, 178 and spurs 179, 180 facing the transport rollers 171, 172, and transport rollers 173, 174, respectively, are provided in the transport unit 7. Thus, each of the first and second transport paths 401*a* and 401*b* can attract the sheet 5 by air suction to transport the sheet 5 and hold the sheet 5 in the waiting mode.

According to this configuration, because the sheet 5 is maintained flat while in the waiting mode, the sheet 5 is decurled or dried with less waiting time, thereby preventing a reduction in the productivity due to a waiting operation. Waiting operations in this embodiment are performed in the same manner as in the above-described embodiments and are not described here.

Figure 27:
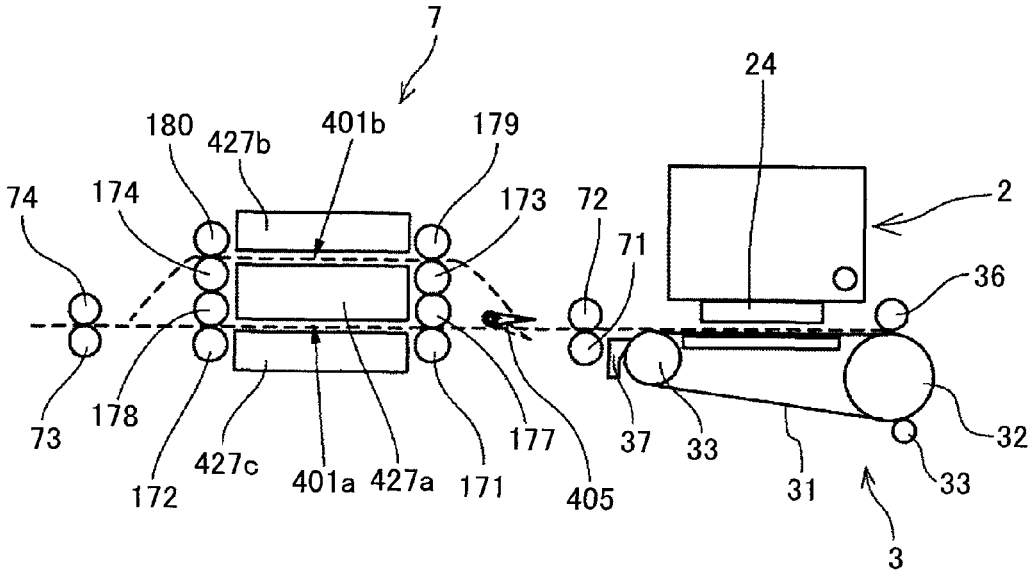
FIG. 27 is a diagram schematically illustrating a transport device according to a ninth embodiment of the present invention.

Next, a transport device according to a ninth embodiment of the present invention is described below with reference to FIG. 27.

In this embodiment, transport guides 427*a*, 427*b*, 427*c* forming the first and second transport paths 401*a* and 401*b* and each having a heating device for accelerating drying of the sheet 5; transport rollers 171, 172 and transport rollers 173, 174 for transporting the sheets 5; and spurs 177, 178 and spurs 179, 180 facing the transport rollers 171, 172, and transport rollers 173, 174, respectively, are provided in the transport unit 7. Each of the first and second transport paths 401*a* and 401*b* can transport the sheet 5 and hold the sheet 5 in the waiting mode while heating the sheet 5.

According to this configuration, because the drying of the sheet 5 is accelerated while the sheet 5 is held in the waiting mode, the sheet 5 is decurled or dried with less waiting time, thereby preventing a reduction in the productivity due to a waiting operation. The heat may be transferred by any of conduction, convection, and radiation. The heat may be generated by any of microwave heating, electromagnetic heating, radiant heating, and resistance heating. The heating devices may be disposed at the upper and lower sides of each of the transport paths 401*a* and 401*b* or may be disposed at only the upper or lower side of each of the transport paths 401*a* and 401*b*. Waiting operations in this embodiment are performed in the same manner as in the above-described embodiments and are not described here.

Figure 28:
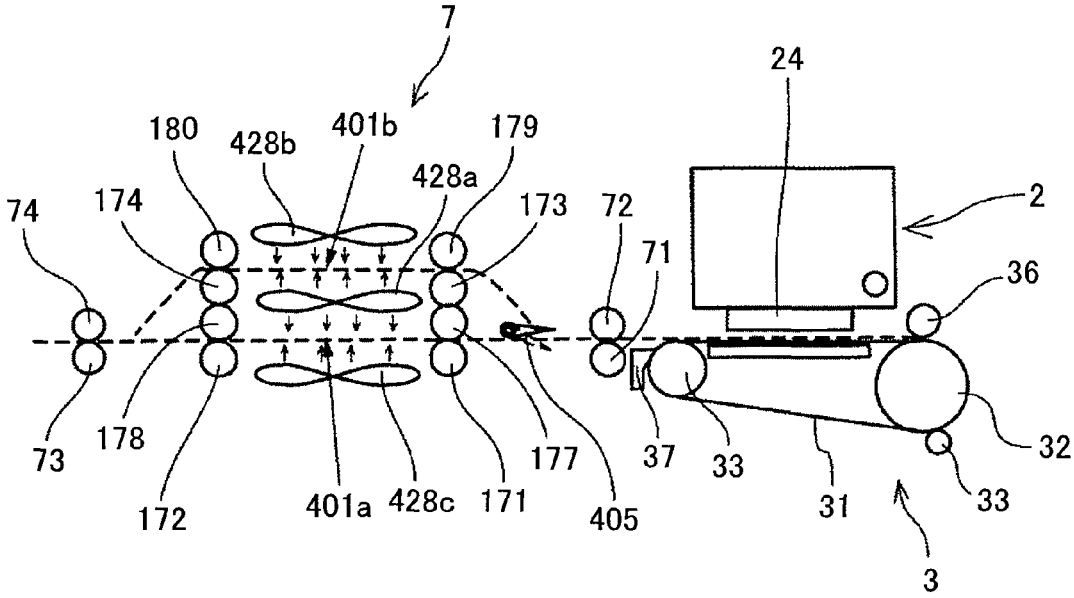
FIG. 28 is a diagram schematically illustrating a transport device according to a tenth embodiment of the present invention.

Next, a transport device according to a tenth embodiment of the present invention is described below with reference to FIG. 28.

In this embodiment, air current generating devices 428*a*, 428*b*, and 428*c* that generate an air current for accelerating drying of the sheets 5 are provided in the transport unit 7. Thus, it is possible to supply an air current to the sheets 5 on transport paths 401*a* and 401*b* while transporting the sheets 5 and causing the sheets 5 to wait thereon.

According to this configuration, because the drying of the sheet 5 is accelerated while the sheet 5 is held in the waiting mode, the sheet 5 is decurled or dried with less waiting time, thereby preventing a reduction in the productivity due to a waiting operation. The air current generating devices 428*a*, 428*b*, and 428*c* may use a fan provided for other purposes. For example, a duct may be provided in the vicinity of an exhaust fan to guide an air current of the exhaust fan to the sheet 5. Waiting operations in this embodiment are performed in the same manner as in the above-described embodiments and are not described here.

The configurations of the first-tenth embodiments may be combined to further increase the effect of the apparatus. For example, the configuration of the ninth embodiment and the configuration of the tenth embodiment may be combined so that the heat of the heating device around the transport path is transferred to the sheet 5 by the air current generated by the air current generating device.

Figure 29:
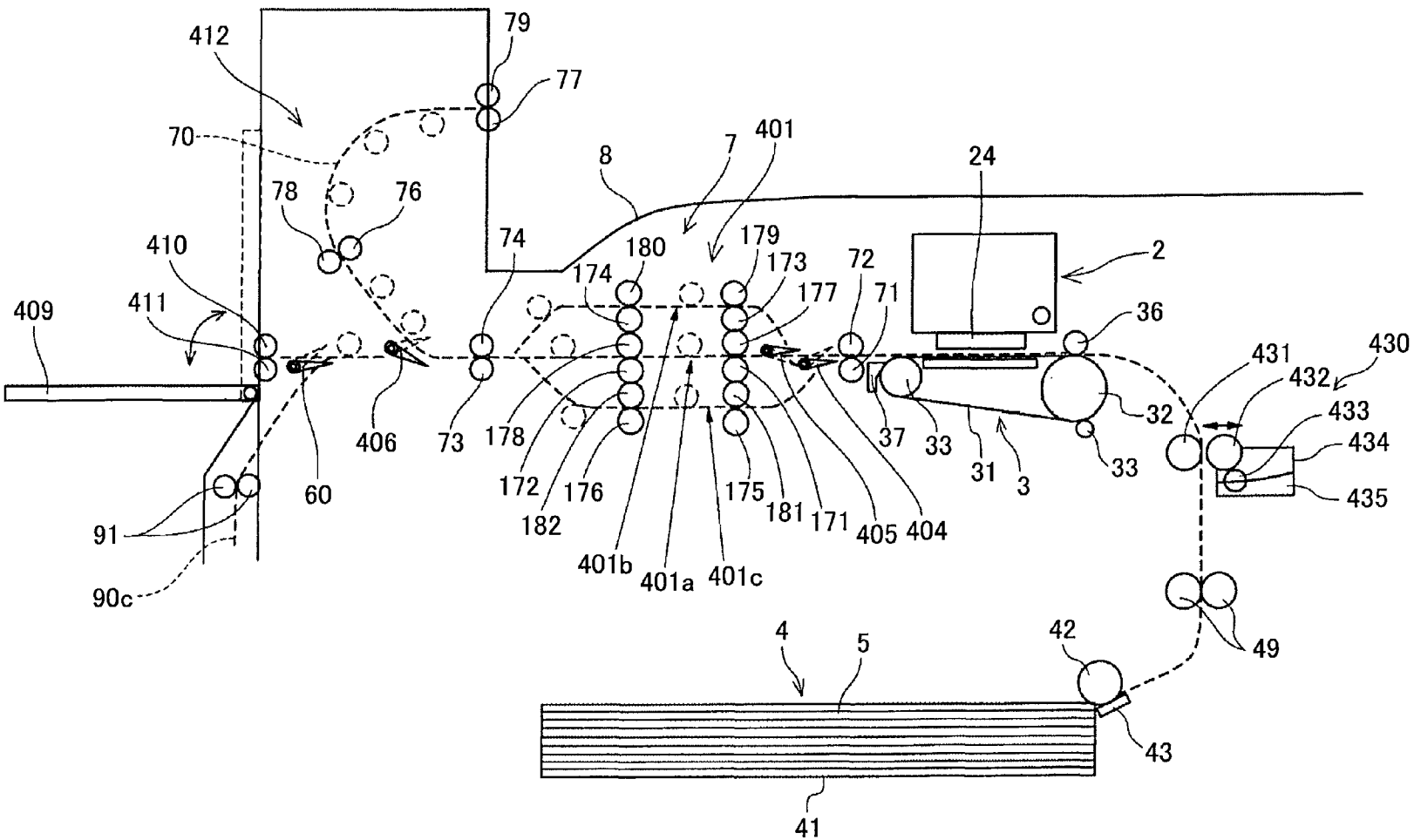

Next, a transport device according to an eleventh embodiment of the present invention is described below with reference to FIG. 29.

In this embodiment, an applicator 430 for applying processing liquid 435 that reacts with and fixes ink droplets is provided in the image forming apparatus. The applicator 430 includes a replaceable processing liquid storing cassette 434; the processing liquid 435 stored in the processing liquid storing cassette 434; an intermediate roller 433 having a surface formed of, for example, a foamed material or a fiber brush for uniformly applying the processing liquid 435 to an applicator roller 432; the applicator roller 432 that applies the processing liquid 435 to the surface of the sheet 5, holds the processing liquid 435 in small grooves formed on its surface by surface tension or capillary action, has the surface made of an inelastic material such as metal, ceramic, and plastic (although materials such as a foamed material, fiber, and cloth may be used, it is preferable to use an inelastic material in order to apply a small amount of the processing liquid 435), and that can be brought into and out of contact with the sheet 5 by a drive unit (not shown) as needed; and a transport roller 431 facing the applicator roller 432 and made of a corrosion resistant material such as nitrile rubber.

The processing liquid 435 is applied to the sheet 5 according to a predetermined condition, thereby reducing waiting time and improving the productivity.

Various other processing liquids may be used as the processing liquid 435. For example, processing liquid having desired properties (e.g., light emitting properties, light blocking properties, conductive properties, fixative properties, glossy properties, and liquid absorbability) may be used. The processing liquid storing cassette 434 may be replaced by another processing liquid storing cassette 434 that stores processing liquid having desired properties. Although the image forming unit 2 is provided in this embodiment, the present invention is applicable to a liquid applicator apparatus comprising, e.g., a liquid applicator and the transport device of this embodiment. Waiting operations in this embodiment are performed in the same manner as in the above-described embodiments and are not described herein.

Figure 30:
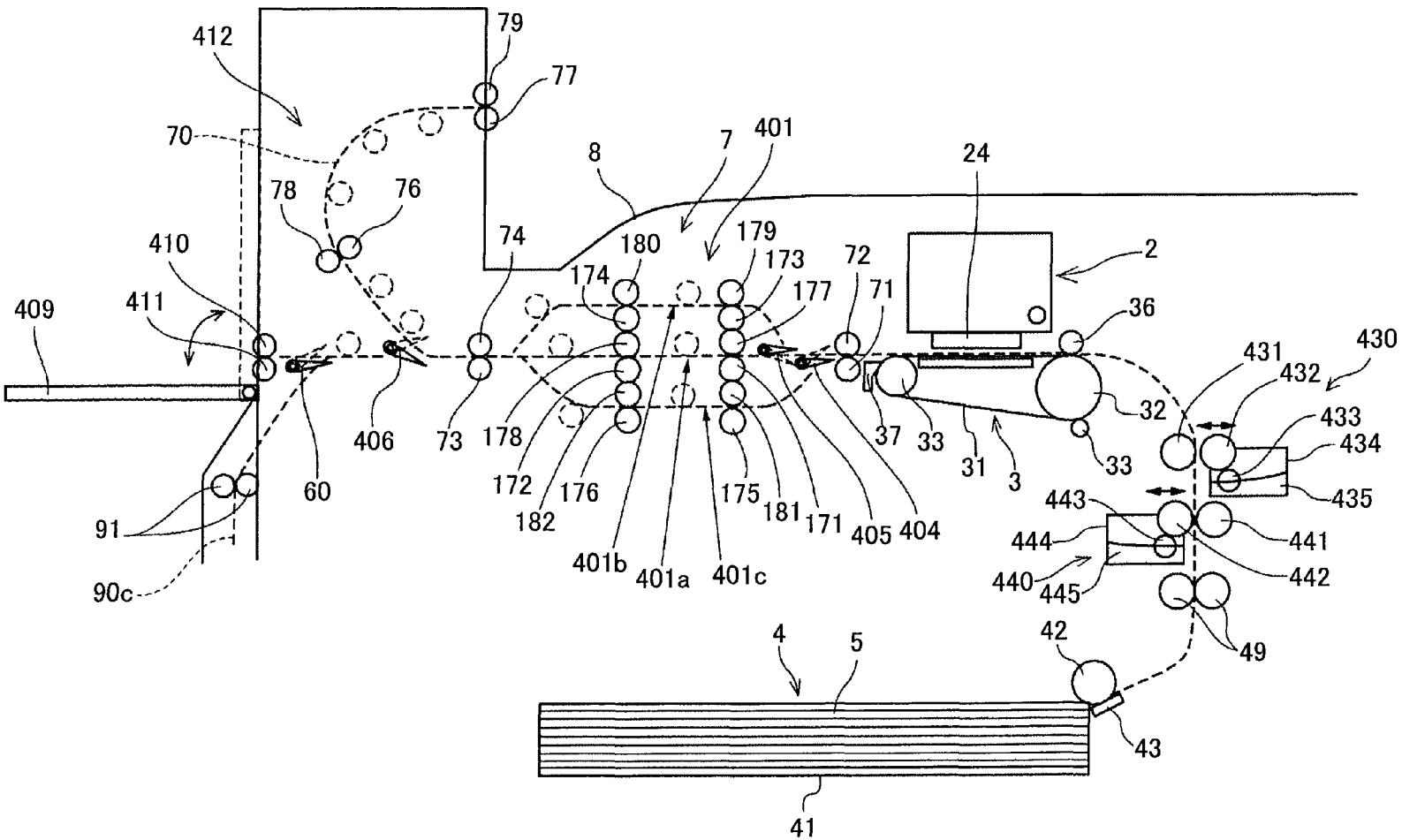
FIG. 30 is a diagram schematically illustrating a transport device according to an eleventh embodiment of the present invention.

Next, a transport device according to a twelfth embodiment of the present invention is described below with reference to FIG. 30.

In this embodiment, in addition to the applicator 430 of the eleventh embodiment, an applicator 440 that applies processing liquid 445 for curling prevention onto the side (non-print side) of the sheet 5. The applicator 440 includes a replaceable processing liquid storing cassette 444; the processing liquid 445 stored in the processing liquid storing cassette 444; an intermediate roller 443 having a surface formed of, for example, a foamed material or a fiber brush for uniformly applying the processing liquid 445 to an applicator roller 442; the applicator roller 442 that applies the processing liquid 445 to the surface of the sheet 5, holds the processing liquid 445 in small grooves formed on its surface by surface tension or capillary action, has the surface made of an inelastic material such as metal, ceramic, and plastic (although materials such as a foamed material, fiber, and cloth may be used, it is preferable to use an inelastic material in order to apply a small amount of the processing liquid 445), and that can be brought into and out of contact with the sheet 5 by a drive unit (not shown) as needed; and a transport roller 441 facing the applicator roller 442 and made of a corrosion resistant material such as nitrile rubber.

For example, image data transmitted from a host device or read by the image reading unit 11 are read before feeding the sheet 5. Then, for example, the applicator roller 442 applies the processing liquid (curling prevention liquid) 445 to the non-print side of the sheet 5 opposite to the side to be printed based on the printing area size and the width of the print area distribution. The substantially same amount of liquid is applied to the front side to the back side of the sheet 5 so that the front and back sides have the substantially same expansion rate, thereby preventing curling. This can reduce waiting time and improve the productivity.

The method of applying the processing liquid is not limited to the method described above. For example, a spray type applicator may be used. Similar to the eleventh embodiment, various other processing liquids may be used as the processing liquid 445. Further, the image forming unit 2 does not have to be provided. For example, the processing liquid 445 is applied to one or both sides of the sheet 5. Then, the sheet 5 is dried by a waiting operation in the transport device of the present invention and is transported and re-fed to the duplexing unit or the like. Thus, a recording unit records on the sheet 5 with the processing liquid 445 dried to a desired level.

The first through twelfth embodiments of the present invention are described above. In the case where pigment ink having viscosity of 5 mPa·s or greater at 25° C. is used as ink, the sheet 5 is easily curled. It is effective to apply the present invention especially in such a case. Use of such an ink makes it possible to form an image having high image density, sufficient coloring properties, double-sided printability, water resistance, and high quick-drying properties with no blurring of characters and thus improve the image quality and to balance the drying properties and the productivity. Further, it is possible to reduce energy use and the cost.

The present application is based on Japanese Priority Application No. 2007-237618 filed on Sep. 13, 2007, with the Japanese Patent Office, the entire contents of which are hereby incorporated herein by reference.

What is claimed is:

1. An image forming apparatus comprising:

a recording head for ejecting droplets of recording liquid to form an image on a particular recording medium; and a decurling unit configured to perform decurling of the particular recording medium after the image has been formed on the particular recording medium, and adjusts the decurling of the particular recording medium based on a first information piece regarding a degree of curl of the particular recording medium having the image has been formed thereon and a second information piece regarding a separate subsequent recording medium that is separate from the particular recording medium, an image being formed on the subsequent recording medium after an image is formed on the particular recording medium.

2. The image forming apparatus as claimed in claim 1, wherein the second information piece includes the number of the subsequent recording media.

3. The image forming apparatus as claimed in claim 1, wherein the second information piece includes a degree of curl of the subsequent recording medium.

4. The image forming apparatus as claimed in claim 1, wherein the second information piece includes the number of the subsequent recording media when a degree of curl of the subsequent recording medium is less than a predetermined degree of curl.

5. The image forming apparatus as claimed in claim 1, wherein the second information piece includes information regarding a type of the subsequent recording medium.

6. The image forming apparatus as claimed in claim 1, wherein in a case that a degree of curl of the subsequent recording medium is less than a predetermined degree and the number of the subsequent recording media is greater than a predetermined number, the decurling unit does not perform the decurling of the particular recording medium or reduce an amount of the decurling of the particular recording medium.

7. The image forming apparatus as claimed in claim 1, wherein the first information piece includes at least one of temperature and humidity, a type of the particular recording medium, a size of the particular recording medium, an amount of the droplets ejected on a predetermined position of the particular recording medium, an image formation mode, and image data.

8. The image forming apparatus as claimed in claim 1, wherein the decurling unit adjusts at least one of a waiting time condition including whether to apply a waiting time, a heating condition including whether to apply heat, a condition regarding air volume supplied to the particular recording medium, a condition regarding application of pressure, and a condition regarding a flatness to be obtained by the decurling.

9. The image forming apparatus as claimed in claim 1, wherein a condition for adjusting the decurling to be performed by the decurling unit is specified or altered via an external device in communication with the image forming apparatus or an operations panel of the image forming apparatus.

10. The image forming apparatus as claimed in claim 1, further comprising:

a transport unit to transport the particular recording medium having the image formed thereon to an output unit, wherein the decurling unit performs said decurling of the particular recording medium while the particular recording medium having the image formed thereon is maintained at a specific position within the transport unit for a waiting time period.

11. The image forming apparatus as claimed in claim 10, wherein the transport unit includes plural transport paths to the output unit, the particular recording medium is transported via a selected one of the plural transport paths of the transport unit to the output unit, and the specific position at which the particular recording medium remains for the waiting time period while the decurling unit performs said decurling of the particular recording medium having the image formed thereon is in the selected transport path.

12. The image forming apparatus as claimed in claim 11, wherein the subsequent recording medium is transported via another one of the plural transport paths to the output unit.

13. The image forming apparatus as claimed in claim 11, wherein the subsequent recording medium is being transported while the particular recording medium having the image formed thereon remains at the specific position in the selected transport path for the waiting time period.

14. The image forming apparatus as claimed in claim 11, further comprising:

a control unit that determines the waiting time period based on the first information piece regarding the degree of curl of the particular recording medium and the second information piece regarding a separate subsequent recording medium, and controls operation of the transport unit to maintain the particular recording medium having the image formed thereon at the specific position in the selected transport path to the output unit for said waiting time period.

* * * * *